US008518626B2

(12) United States Patent
Yamada et al.

(10) Patent No.: US 8,518,626 B2
(45) **Date of Patent: *Aug. 27, 2013**

(54) CARRIER, METHOD FOR PREPARING THE CARRIER, DEVELOPER USING THE CARRIER, DEVELOPER CONTAINER, AND IMAGE FORMING METHOD AND APPARATUS AND PROCESS CARTRIDGE USING THE DEVELOPER

(75) Inventors: Saori Yamada, Shizuoka (JP); Minoru Masuda, Shizuoka (JP); Hisashi Nakajima, Shizuoka (JP); Kimitoshi Yamaguchi, Shizuoka (JP); Koichi Sakata, Shizuoka (JP); Hitoshi Iwatsuki, Shizuoka (JP); Yutaka Takahashi, Kanagawa (JP); Toyoaki Tano, Shizuoka (JP); Mariko Takii, Shizuoka (JP)

(73) Assignee: Ricoh Company, Limited, Tokyo (JP)

( * ) Notice: Subject to any disclaimer, the term of this patent is extended or adjusted under 35 U.S.C. 154(b) by 289 days.

This patent is subject to a terminal disclaimer.

(21) Appl. No.: 13/037,569

(22) Filed: Mar. 1, 2011

(65) Prior Publication Data

US 2011/0229817 A1 Sep. 22, 2011

(30) Foreign Application Priority Data

Mar. 17, 2010 (JP) ..... 2010-060071
Sep. 6, 2010 (JP) ..... 2010-198627

(51) Int. Cl.
*G03G 9/00* (2006.01)

(52) U.S. Cl.
USPC ..... 430/111.35; 430/111.1; 430/111.3; 430/111.31; 430/123.4

(58) Field of Classification Search
USPC ..... 430/111.1, 111.3, 111.31, 111.35, 430/123.4
See application file for complete search history.

(56) References Cited

U.S. PATENT DOCUMENTS

| | | | |
|---|---|---|---|
| 4,954,409 | A | 9/1990 | Aoki et al. |
| 5,468,825 | A | 11/1995 | Takarada et al. |
| 7,192,679 | B2 | 3/2007 | Yamaguchi et al. |
| 7,320,852 | B2 | 1/2008 | Kotsugai et al. |
| 7,381,513 | B2 | 6/2008 | Suzuki et al. |

(Continued)

FOREIGN PATENT DOCUMENTS

| | | |
|---|---|---|
| JP | 55-127569 | 10/1980 |
| JP | 55-157751 | 12/1980 |

(Continued)

OTHER PUBLICATIONS

U.S. Appl. No. 12/978,920, filed Dec. 27, 2010, Sakata, et al.

*Primary Examiner* — Mark F Huff
*Assistant Examiner* — Stewart Fraser
(74) *Attorney, Agent, or Firm* — Oblon, Spivak, McClelland, Maier & Neustadt, L.L.P.

(57) ABSTRACT

The carrier is used for a two-component developer for developing an electrostatic latent image, and includes a particulate magnetic core material; and a cover layer located on a surface of the particulate magnetic core material and including a crosslinked material. The crosslinked material is formed by hydrolyzing a copolymer including at least a unit (A) having a specific acrylic siloxane structure including a tris(trialkylsiloxy)silanyl group and a unit (B) having a specific acrylic silicone structure to form a material having a silanol group, and subjecting the material having a silanol group to a condensation reaction using an organic zirconium-containing catalyst.

18 Claims, 3 Drawing Sheets

(56) References Cited

U.S. PATENT DOCUMENTS

| | | | | |
|---|---|---|---|---|
| 7,468,233 | B2 | 12/2008 | Nagayama et al. | |
| 7,527,908 | B2 | 5/2009 | Iwatsuki et al. | |
| 7,553,598 | B2 | 6/2009 | Suzuki et al. | |
| 7,592,116 | B2 | 9/2009 | Suzuki et al. | |
| 7,763,410 | B2 | 7/2010 | Yamaguchi et al. | |
| 8,211,610 | B2 * | 7/2012 | Yamaguchi et al. | 430/111.35 |
| 2006/0210905 | A1 | 9/2006 | Imahashi et al. | |
| 2007/0048652 | A1 | 3/2007 | Imahashi et al. | |
| 2007/0141502 | A1 | 6/2007 | Aga et al. | |
| 2007/0243482 | A1 | 10/2007 | Yamaguchi et al. | |
| 2008/0063969 | A1 * | 3/2008 | Yamaguchi et al. | 430/110.2 |
| 2008/0073252 | A1 | 3/2008 | Yamaguchi et al. | |
| 2008/0213684 | A1 | 9/2008 | Nagayama et al. | |
| 2008/0227004 | A1 | 9/2008 | Yamaguchi et al. | |
| 2009/0041510 | A1 | 2/2009 | Imahashi et al. | |
| 2009/0074450 | A1 | 3/2009 | Nagayama et al. | |
| 2009/0092920 | A1 | 4/2009 | Nagayama et al. | |
| 2010/0233613 | A1 | 9/2010 | Masuda et al. | |
| 2010/0239975 | A1 | 9/2010 | Yamaguchi et al. | |
| 2011/0086307 | A1 * | 4/2011 | Nakajima et al. | 430/111.3 |
| 2011/0091802 | A1 * | 4/2011 | Takahashi et al. | 430/108.3 |

FOREIGN PATENT DOCUMENTS

| | | |
|---|---|---|
| JP | 56-140358 | 11/1981 |
| JP | 57-96355 | 6/1982 |
| JP | 57-96356 | 6/1982 |
| JP | 58-207054 | 12/1983 |
| JP | 61-110161 | 5/1986 |
| JP | 62-273576 | 11/1987 |
| JP | 6-222621 | 8/1994 |
| JP | 2001-92189 | 4/2001 |
| JP | 2006-337828 | 12/2006 |
| JP | 2010-244026 | 10/2010 |

* cited by examiner

CARRIER, METHOD FOR PREPARING THE CARRIER, DEVELOPER USING THE CARRIER, DEVELOPER CONTAINER, AND IMAGE FORMING METHOD AND APPARATUS AND PROCESS CARTRIDGE USING THE DEVELOPER

BACKGROUND OF THE INVENTION

1. Field of the Invention

The present invention relates to a carrier for use in a two-component developer developing an electrostatic image, to a method for preparing the carrier, and a two-component developer using the carrier and a toner. In addition, the present invention also relates to a developer container, and an image forming method, an image forming apparatus and a process cartridge using the two-component developer.

2. Description of the Related Art

Electrophotographic image forming methods typically include the following processes:

(1) Forming an electrostatic latent image on an image bearing member such as a photoreceptor;

(2) Developing the electrostatic latent image with a developer including a toner to form a toner image on the image bearing member;

(3) Transferring the toner image onto a recording material; and (4) Fixing the toner image on the recording material, resulting in formation of an output image.

Recently, in the field of electrophotography, transition is rapidly being made from monochrome imaging to full color imaging, and the market for full color imaging is rapidly expanding.

In full color imaging, all the color images are formed by forming primary color toner images using four color toners, i.e., yellow, magenta, cyan and black toners, while forming secondary color toner images by overlaying two or more of the primary color toner images. Therefore, in order to prepare a full color image having a good combination of color reproducibility and clearness, each of fixed color toner images preferably has a smooth surface to reduce light scattering at the surface. For this reason, color images produced by conventional full color image forming apparatus typically have a relatively high glossiness of from 10% to 50%.

With respect to the image fixing method, contact heat fixing methods in which a heated fixing member such as a heat roller or belt is contacted with a toner image upon application of pressure thereto are widely used. Such contact heat fixing methods have advantages of fixing a toner image at a high speed and a high heat efficiency while imparting a good combination of glossiness and transparency to the toner image. However, the contact heat fixing methods have a drawback in that they often cause an offset problem, in which a part of a toner image is adhered to a fixing member, and the adhered toner is transferred again to the image or another image, resulting in formation of an abnormal image, because the toner image is contacted with the fixing member upon application of heat and pressure to be melted.

In attempting to prevent occurrence of the offset problem, typically fixing methods are used in which a fixing roller having a surface made of a material having good releasability such as silicone rubbers and fluorine-containing resins is used while applying a toner adhesion preventing agent such as silicone oils to the surface of the fixing roller. Although such fixing methods are effective in preventing occurrence of the offset problem, the methods have a drawback in that, since an oil applicator has to be provided, the fixing device becomes unacceptably large. Therefore, recent monochrome image forming apparatuses tend to use toner having a relatively high melt viscoelasticity and including a release agent in combination with an oil-less fixing device or an oil micro-coating fixing device, in which a small amount of oil is applied to a fixing member.

Similarly, oil-less fixing methods are often used for full color image forming apparatuses to miniaturize the fixing devices thereof and simplify the configuration. However, since full color image forming apparatuses preferably produce glossy images as mentioned above, color toners used therefor preferably have a lower viscoelasticity than toners used for monochrome image forming apparatuses, thereby increasing the chance of occurrence of the offset problem. Therefore, it is difficult for full color image forming apparatuses to use an oil-less fixing device.

In addition, toner including a release agent has drawbacks in that transferability of the toner to a recording material deteriorates because of having high adhesiveness to the surface of carrier, and a toner filming problem in that a film of toner is formed on the surface of the carrier used in combination of the toner, resulting in deterioration of the charging ability and durability (life) of the carrier On the other hand, coated carriers in which a resin having a low surface energy such as fluorine-containing resins and silicone resins is uniformly applied on a core material thereof are provided in order to prolong the life thereof, i.e., to prevent occurrence of the toner filming problem and other problems such that the surface of the carriers is oxidized, the moisture resistance of the carriers deteriorates, the carriers are adhered to image bearing members, and the carriers damage and abrade the surface of image bearing members, and to control the polarity and quantity of charge of the carriers.

Specific examples of the coated carriers having a surface coated with a resin having a low surface energy include a carrier having a cover layer formed by using a room temperature crosslinking silicone resin and a positively chargeable nitrogen-containing resin; a carrier having a cover layer formed of a material including at least a modified silicone resin; a carrier having a cover layer formed by using a room temperature crosslinking silicone resin and a styrene-acrylic resin; carriers having multiple cover layers formed by using silicone resins, wherein the cover layers may have poor adhesiveness with each other; a carrier having a cover layer including a polyvinyl acetal resin crosslinked with an isocyanate compound; a carrier having a cover layer including a silicone resin and silicon carbide; a positively chargeable carrier having a cover layer formed of a material having a critical surface tension of not greater than 20 dyne/cm; and a developer consisting of a carrier having a cover layer formed by using a coating agent including a fluorinated alkylacrylate, and a toner including chromium-containing azo dye.

In addition, there are proposals such that a cover layer including a polysiloxane is formed on a core material by using a coating liquid including a siloxane compound having a condensation-reactive silanol group or a precursor group thereof (e.g., hydrolysable groups such as halosilyl groups and alkoxysilyl groups), and a titanium-containing condensation reaction catalyst.

For example, there is a proposal for a carrier such that a cover layer is formed on a core material thereof using a silicone resin and an organic titanium-containing catalyst. Specific examples of such an organic titanium-containing catalyst include titanium diisopropoxybis(acetylacetonate), tetraisopropoxy titanium, titanium isopropoxy(2-ethylhexanedioate), bis(acryloyloxy)isopropoxyisostearolyloxy titanium, and titanium bis(2,4-pentanedionate) (1,3-propanedioate).

In addition, there is a proposal for a carrier in which a cover layer is formed on a core material thereof using a coating liquid including a composition including as main components an organopolysiloxane, an organosilane, and at least one of crosslinking catalysts selected from the group consisting of titanium-containing compounds (e.g., tetraisopropoxy titanium), tin-containing compounds (e.g., dibutyl tin diacetate), zinc-containing compounds, cobalt-containing compounds, iron-containing compounds, aluminum-containing compounds and amine compounds.

Further, there is a proposal for a carrier in which a cover layer is formed on a core material thereof using a coating liquid including a silicone resin or a modified silicone resin, and a quaternary ammonium salt type catalyst, an aluminum-containing catalyst or a titanium-containing catalyst (e.g., titanium diisopropoxybis(acetylacetonate).

Further, in order to produce high quality images, the diameter of the particles that constitute the toner is being reduced. When images are formed at a high speed using such small toner particles, the spent toner problem is easily caused. In this regard, when a wax is included in the toner as a release agent, the amount of spent toner adhered to the carrier seriously increases, thereby degrading the charging ability of the carrier and decreasing the charge quantity of the toner, resulting in occurrence of the toner scattering problem and the background development problem.

In full color image formation systems, when spent toner is adhered to the surface of a carrier, or the cover layer of a carrier is abraded or released, the resistance of the carrier and the amount of toner born by the surface of the carrier change, resulting in a change of image density (particularly image density of highlighted portions). In addition, when a filler included in a cover layer of a carrier is released therefrom due to abrasion of the cover layer and mixed with a color toner used in combination therewith, the color of the color toner (particularly yellow toner) is changed, resulting in deterioration of the color reproducibility of images.

For these reasons, the inventors recognized that there is a need for a carrier which can produce high quality images in combination with toner without causing the above-mentioned problems such as the spent toner problem, the toner scattering problem, and the background development problem.

SUMMARY

This patent specification describes a novel carrier for use in a two-component developer for developing an electrostatic latent image, one embodiment of which includes a particulate magnetic core material, and a cover layer located on a surface of the core material and including a crosslinked material. The crosslinked material is formed by hydrolyzing a copolymer including a unit (A) having the below-mentioned formula (A) and a unit (B) having the below-mentioned formula (B) to prepare a material having a silanol group, and subjecting the material to a condensation reaction using an organic zirconium-containing catalyst.

(A)

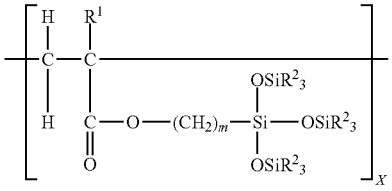

-continued (B)

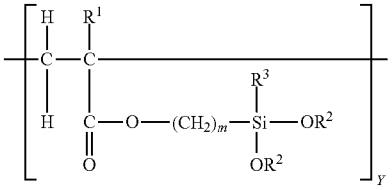

wherein each of $R^1$ represents a hydrogen atom or a methyl group, each of m is an integer of from 1 to 8, each of $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B, wherein X is from 10% by mole to 90% by mole and Y is from 90% by mole to 10% by mole. The groups $R^1$ are the same as or different from each other. The numbers m are the same as or different from each other. The groups $R^2$ are the same as or different from each other.

This patent specification further describes a novel two-component developer for developing an electrostatic latent image, one embodiment of which includes a toner and the above-mentioned carrier.

This patent specification further describes a novel carrier forming method, one embodiment of which includes applying a coating medium including a copolymer including a unit (A) having the above-mentioned formula (A) and a unit (B) having the above-mentioned formula (B), and an organic zirconium-containing catalyst to a particulate core material so that the copolymer is hydrolyzed to produce a material having a silanol group, and the material having a silanol group is subjected to a condensation reaction using the zirconium-containing catalyst to form a cover layer including a crosslinked material on a surface of the particulate core material.

This patent specification further describes a novel developer container, one embodiment of which contains the above-mentioned two-component developer.

This patent specification further describes a novel image forming method, one embodiment of which includes forming an electrostatic latent image on an image bearing member; developing the electrostatic latent image with the above-mentioned two-component developer to form a toner image on the image bearing member; transferring the toner image to a recording material; and fixing the toner image to the recording material.

This patent specification further describes a novel process cartridge, one embodiment of which includes at least an image bearing member to bear an electrostatic latent image; and a developing device to develop the electrostatic latent image with the above-mentioned developer to form a toner image on the image bearing member, wherein the image bearing member and the developing device are integrated into a single unit.

This patent specification further describes a novel image forming apparatus, one embodiment of which includes an image bearing member to bear an electrostatic latent image; a charger to charge a surface of the image bearing member; an irradiating device to irradiate the charged surface of the image bearing member with light to form the electrostatic latent image on the surface of the image bearing member; a developing device to develop the electrostatic latent image with the above-mentioned two-component developer to form a toner image on the image bearing member; a transferring device to transfer the toner image to a recording material optionally via an intermediate transfer medium; a fixing device to fix the toner image on the recording material; and a cleaner to clean the surface of the image bearing member after the toner image on the image bearing member is transferred.

BRIEF DESCRIPTION OF THE DRAWINGS

Amore complete appreciation of the aspects of the invention and many of the attendant advantage thereof will be readily obtained as the same better understood by reference to the following detailed description when considered in connection with the accompanying drawings, wherein.

DESCRIPTION OF THE PREFERRED EMBODIMENTS

Figure 1:
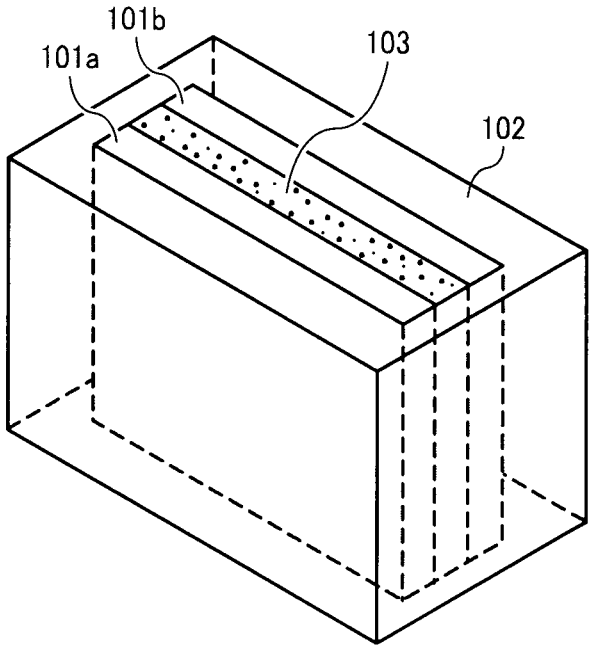
FIG. 1 is a schematic view illustrating a cell used for measuring the volume resistivity of a carrier.

Initially, the carrier of the present invention will be described.

The carrier of the present invention includes a particulate magnetic core material and a cover layer formed on the surface of the core material.

The cover layer includes at least a crosslinked material. The crosslinked material is prepared by hydrolyzing a copolymer including a unit (A) having the below-mentioned formula (A) and a unit (B) having the below-mentioned formula (B) to produce a material having a silanol group, and then subjecting the material to a condensation reaction using an organic zirconium-containing catalyst.

(A)

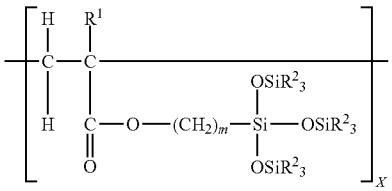

(B)

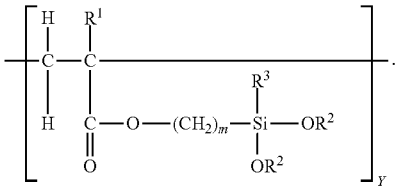

In formulae (A), $R^1$ represents a hydrogen atom or a methyl group, m is an integer of from 1 to 8 (i.e., $(CH_2)_m$ represents an alkylene group having 1 to 8 carbon atoms), each of $R^2$ represents an alkyl group having 1 to 4 carbon atoms, and X represents the molar ratio of the unit (A), wherein X is from 10% by mole to 90% by mole.

Specific examples of the alkylene groups for use as the group $(CH_2)_m$ include methylene, ethylene, propylene and butylene groups, but are not limited thereto. Specific examples of the alkyl groups having 1 to 4 carbon atoms for use as the group $R^2$ include methyl, ethyl, propyl, isopropyl and butyl groups, but are not limited thereto. The groups $R^2$ are the same as or different from each other.

The molar ratio X of the unit (A) is from 10% by mole to 90% by mole, and preferably from 30% by mole to 70% by mole. The unit (A) has an atom group including plural alkyl groups, i.e., a tris(trialkylsiloxy)silane group, in the side chain thereof. When the molar ratio X of the unit (A) increases, the surface energy of the copolymer decreases, and thereby the amount of resin and wax components of the toner adhered to the surface of the carrier can be decreased. When the molar ratio X is lower than 10% by mole, the above-mentioned effect can be hardly produced, i.e., resin and wax components of the toner tend to be easily adhered to the surface of the carrier. By contrast, when the molar ratio X is higher than 90% by mole, the ratio Y of the unit (B) decreases, thereby insufficiently crosslinking the copolymer in the heat treatment, resulting in occurrence of problems in that toughness of the cover layer and adhesion of the cover layer to the core material deteriorate, resulting in deterioration of the durability of the cover layer.

Specific examples of monomers capable of forming the unit (A) include tris(trialkylsiloxy)silane compounds having the following formulae.

$CH_2{=}CMe{-}COO{-}C_3H_6{-}Si(OSiMe_3)_3$ $CH_2{=}CH{-}COO{-}C_3H_6{-}Si(OSiMe_3)_3$ $CH_2{=}CMe{-}COO{-}C_4H_8{-}Si(OSiMe_3)_3$ $CH_2{=}CMe{-}COO{-}C_3H_6{-}Si(OSiEt_3)_3$ $CH_2{=}CH{-}COO{-}C_3H_6{-}Si(OSiEt_3)_3$ $CH_2{=}CMe{-}COO{-}C_4H_8{-}Si(OSiEt_3)_3$ $CH_2{=}CMe{-}COO{-}C_3H_6{-}Si(OSPr_3)_3$ $CH_2{=}CH{-}COO{-}C_3H_6{-}Si(OSiPr_3)_3$ $CH_2{=}CMe{-}COO{-}C_4H_8{-}Si(OSiPr_3)_3$

In the formulae above, Me represents a methyl group, Et represents an ethyl group, and Pr represents a propyl group.

These monomers can be used alone or in combination.

The method for preparing a monomer for use in forming the unit (A) is not particularly limited. For example, a method in which a tris(trialkylsiloxane)silane is reacted with allyl acrylate or allyl methacrylate in the presence of a platinum catalyst; a method disclosed in published unexamined Japanese patent applications No. JP-H11-217389-A in which a methacryloyloxyalkyltrialkoxysilane is reacted with a hexaalkyldisiloxane in the presence of a carboxylic acid and an acid catalyst; etc. can be used.

In formula (B), $R^1$ represents a hydrogen atom or a methyl group, m is an integer of from 1 to 8 (i.e., $(CH_2)_m$ represents an alkylene group having 1 to 8 carbon atoms), each of $R^2$ represents an alkyl group having 1 to 4 carbon atoms, $R^3$ represents an alkyl group having 1 to 8 carbon atoms or an alkoxyl group having 1 to 4 carbon atoms, and Y represents the molar ratio of the unit (B), wherein Y is from 10% by mole to 90% by mole. The group $R^1$ in formula (B) is the same as or different from $R^1$ in formula (A). In addition, the groups $R^1$ in formula (B) are the same as or different from the groups $R^2$ in formula (A). Further, the number m in formula (B) is the same as or different from the number m in formula (A).

Specific examples of the alkylene groups for use as the group $(CH_2)_m$ include methylene, ethylene, propylene and butylene groups, but are not limited thereto. Specific examples of the alkyl groups having 1 to 4 carbon atoms for use as the group $R^2$ include methyl, ethyl, propyl, isopropyl and butyl groups, but are not limited thereto. The groups $R^2$ are the same as or different from each other. Specific examples of the alkyl groups having 1 to 8 carbon atoms for use as the group $R^3$ include methyl, ethyl, propyl, isopropyl and butyl groups, but are not limited thereto. Specific examples of the alkoxyl groups having 1 to 4 carbon atoms for use as the group $R^3$ include methoxy, ethoxy, propoxy and butoxy groups, but are not limited thereto.

The unit (B) functions as a crosslinking component. The molar ratio Y of the unit (B) is from 10% by mole to 90% by mole, and preferably from 30% by mole to 70% by mole. When the molar ratio Y is lower than 10% by mole, the resultant cover layer tends to have insufficient toughness. By contrast, when the molar ratio Y is higher than 90% by mole, the resultant cover layer becomes hard and brittle, and thereby the cover layer is easily abraded. In addition, the resultant cover layer tends to exhibit poor stability to withstand environmental conditions. The reason therefor is considered to be that a number of silanol groups remain in the crosslinked material, thereby degrading the environmental stability of the cover layer (i.e., the properties of the cover layer seriously change depending on ambient humidity).

Specific examples of monomers for use in preparing the unit (B) include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, 3-acryloxypropyltri(isopropoxy)silane, etc. These monomers can be used alone or in combination.

The copolymer used for preparing the crosslinked material included in the cover layer has the following formula (2):

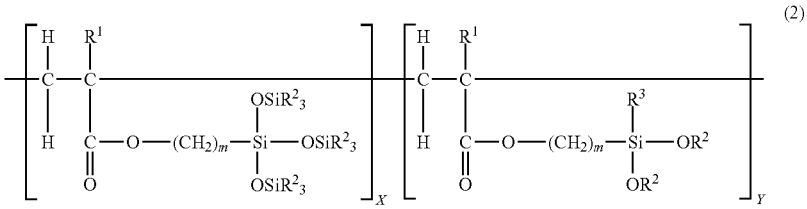

(2)

wherein $R^1$, $R^2$, $R^3$, m, X and Y are defined above.

A technique for imparting good durability to a film by crosslinking the film is disclosed, for example, in Japanese patent No. 3691115(JP-3691115-B). It is disclosed that the surface of a particulate magnetic material is covered with a thermally crosslinked resin, which is prepared by crosslinking a copolymer obtained from an organopolysiloxane having a vinyl group at an end thereof and a radically polymerizable monomer having at least one functional group selected from the group consisting of hydroxyl, amino, amide and imide groups using an isocyanate compound, to prepare a coated carrier for use in electrophotographic developers. However, as a result of the present inventors' investigation, the cover layer does not have good durability, so that a peeling/abrasion problem in that the cover layer of the coated carrier is peeled or abraded is easily caused.

The reason why such a cover layer does not have good durability is not yet clear, but is likely to be as follows. When such a copolymer as mentioned above is crosslinked by using an isocyanate compound, the number of functional groups capable of reacting with the isocyanate compound per a unit weight of the copolymer is small, and thereby a film having a dense two- or three-dimensional network cannot be formed. Therefore, the resultant carrier easily causes the peeling/abrasion problem, i.e., the carrier has insufficient durability.

When the peeling/abrasion problem is caused, the electric resistance of the carrier deteriorates, thereby degrading the quality of images produced by a developer using the carrier. In addition, a carrier adhesion problem in that carrier particles in a developer adhere to an electrostatic latent image is caused. Further, when the peeling/abrasion problem is caused, the fluidity of the developer deteriorates, thereby causing a problem in that the developer cannot be properly attracted to a developer bearing member configured to bear the developer to develop an electrostatic latent image, resulting in decrease of image density. In addition, in this case the toner concentration in the developer increases, and thereby the background development problem and/or the toner scattering problem are easily caused.

By contrast, in the cover film of the carrier of the present invention, the number of crosslinkable di- or tri-functional groups included in the copolymer having formula (3) per unit weight thereof is twice or three times that in the copolymer used for the carrier disclosed in JP-3691115-B. In addition, since the copolymer having formula (3) is further subjected to a condensation polymerization to be crosslinked, the resultant cover layer has a good combination of toughness and abrasion resistance, resulting in improvement of the durability of the carrier.

Further, the siloxane bond constituting the crosslinked material of the cover layer of the carrier of the present invention has higher bond energy than the crosslinked material of the carrier of JP-3691115-B and which is prepared by using an isocyanate compound. Therefore, the cover layer of the carrier of the present invention is stable even when suffering thermal stresses. Namely, the cover layer can maintain good stability over a long period of time.

With respect to the condensation catalyst for subjecting the unit (B) to a condensation reaction, titanium-containing catalysts, tin-containing catalysts, zirconium-containing catalysts, aluminum-containing catalysts, etc., can be used. Among these catalysts, organic zirconium-containing catalysts are preferably used. Specific examples thereof include zirconium alkoxides such as zirconium tetra-n-propoxide, and zirconium tetra-n-butoxide; zirconium chelates such as zirconium tetraacetylacetonate, zirconium tributoxymonoacetylacetonate, zirconium monobutoxyacetylacetonatebis(ethylacetoacetate), and zirconium dibutoxybis(ethylacetoacetate); zirconium acylates such as zirconium tributoxymonostearate; etc.

These catalysts can be used alone or in combination.

Among these organic zirconium-containing catalysts, zirconium chelates are preferable, and zirconium tetraacetylacetonate is more preferable because of having good condensation reaction accelerating effect and being hardly deactivated.

Zirconium alkoxides, zirconium chelates, zirconium acylates, etc. are used as catalysts for the unit (B) (crosslinkable unit) having a silanol group and/or a hydrolysable functional group, but serve as monomers. When such zirconium compounds serve as monomers, the zirconium compounds are incorporated in the resultant resin. When catalysts not serving as monomers are used, the catalysts remain in the resultant resin as themselves. Therefore, when the added amount of the catalysts is increased, problems in that the resultant coated carrier becomes tacky or the surface energy of the carrier increases, and thereby toner is easily adhered to the carrier, resulting in occurrence of the spent toner problem are caused.

By contrast, the organic zirconium-containing catalysts such as zirconium alkoxides, zirconium chelates and zirconium acylates are incorporated in the resultant resin, and therefore the above-mentioned problems are hardly caused even when the added amount of the catalysts is increased. The added mount of an organic zirconium-containing catalyst is preferably from 0.5 to 20 parts by weight, and more preferably from 2 to 15 parts by weight, per 100 parts by weight of the resin having a silanol group and/or a hydrolysable functional group used. Since such a catalyst serves as a monomer, no problem occurs even when the added amount is as large as 20 parts by weight per 100 parts by weight of the resin used because the catalyst is incorporated in the resultant resin as a unit. When the added amount is less than 0.5 parts by weight, the crosslinking reaction tends to be insufficiently induced in the heating treatment, resulting in deterioration of the properties of the cover layer. By contrast, when the added amount is greater than 20 parts by weight, the amount of the catalyst, which is not incorporated as a unit in the resultant resin, increases (i.e., a large amount of catalyst, which has a low molecular weight, remains as itself in the cover layer, thereby causing problems in that the coated carrier becomes tacky, and the mechanical strength of the cover layer is deteriorated.

The cover layer can be prepared by using a cover layer coating liquid including at least a silicone resin having a silanol group and/or a hydrolysable functional group, and an organic zirconium-containing catalyst, and optionally including a solvent, a resin other than the silicone resin having a silanol group and/or a hydrolysable functional group.

Specifically, a method in which a particulate core material is coated with the cover layer coating liquid while subjecting the silanol group to a condensation reaction, or a method in which a particulate core material is coated with the cover layer coating liquid, and then the silanol group is subjected to a condensation reaction can be used. The first-mentioned method is not particularly limited, and specific examples thereof include a method in which a particulate core material is coated with the cover layer coating liquid while applying heat and/or light thereto can be used. The second-mentioned method is not particularly limited, and specific examples thereof include a method in which after a particulate core material is coated with the cover layer coating liquid, the coated particulate material is subjected to a heat treatment.

In general, resins having a high molecular weight have a high viscosity. Therefore, when a particulate core material, which has a small particle diameter, is coated with a coating liquid including such a high molecular weight resin, problems in that the core material aggregates, and/or an uneven cover layer is formed on the core material tend to be caused. Namely, it is difficult to prepare a coated carrier using such a high molecular weight resin. Therefore, the copolymer used for forming a cover layer of the carrier of the present invention preferably has a weight average molecular weight of from 5,000 to 100,000, more preferably from 10,000 to 70,000, and even more preferably from 30,000 to 40,000. When the weight average molecular weight is lower than 5,000, the mechanical strength of the cover layer tends to deteriorate. When the weight average molecular weight is higher than 100,000, the viscosity of the coating liquid tends to seriously increase, thereby deteriorating the productivity of the carrier.

It is preferable that after the core material is coated with a coating liquid, the coated core material is subjected to a heat treatment to satisfactorily condense the copolymer included in the coated layer, resulting in enhancement of the mechanical strength of the cover layer. Even when a developer including such a carrier is used and the developer is agitated for a long period of time in a developing device while a supplementary toner is hardly supplied to the developer, the cover layer of the carrier is hardly abraded, and occurrence of a white spot problem in that white spot images are formed due to decrease of the electric resistance of the carrier due to adhesion of the toner to the surface of the carrier can be prevented. The temperature of the heat treatment is preferably from 100 to 230° C. When the temperature is lower than 100° C., the condensation reaction of the copolymer tends to be insufficiently induced, resulting in deterioration of the mechanical strength of the cover layer. By contrast, when the temperature is higher than 230° C., the cover layer tends to color. When such a colored cover layer is abraded and mixed with a toner, the color tone of the toner images changes, resulting in deterioration of the color reproducibility of the color images.

In order that the cover layer has good flexibility, and the resin of the cover layer has good adhesion to the core material and a particulate electroconductive material optionally included in the cover layer, it is preferable that the copolymer have a unit (C) having the following formula (C):

(C)

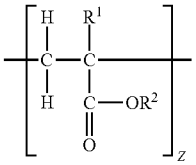

wherein $R^1$ represents a hydrogen atom or a methyl group, $R^2$ represents an alkyl group having 1 to 4 carbon atoms (such as methyl, ethyl, propyl and butyl groups), and Z represents the molar ratio of the unit.

In this case, the copolymer has the following formula (1):

(1)

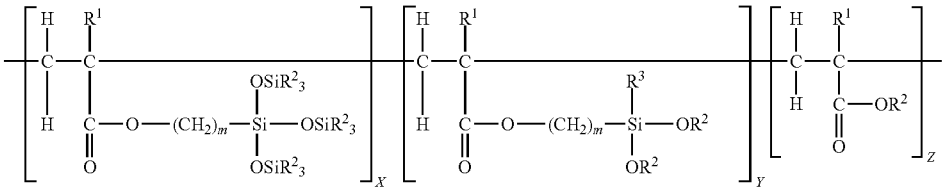

wherein each of $R^1$ represents a hydrogen atom or a methyl group, each of m is an integer of from 1 to 8 (i.e., $(CH_2)_m$ represents an alkylene group having 1 to 8 carbon atoms (such as methylene, ethylene, propylene and butylene groups)), each of $R^2$ represents an alkyl group having 1 to 4 carbon atoms, and $R^3$ represents an alkyl group having 1 to 8 carbon atoms (such as methyl, ethyl, propyl, isopropyl and butyl groups) or an alkoxyl group having 1 to 4 carbon atoms (such as methoxy, ethoxy, propoxy and butoxy groups). The plural groups $R^1$ may be the same as or different from each other, and the plural groups $R^2$ may be the same as or different from each other.

In formula (1), X, Y and Z respectively represent molar ratios of the units (A), (B) and (C), and X is from 10% by mole to 40% by mole, Y is from 10% by mole to 40% by mole, and Z is from 30% by mole to 80% by mole, and preferably from 35% by mole to 75% by mole, wherein 60% by mole<Y+Z<90% by mole, and preferably 70% by mole<Y+Z<85% by mole.

When the molar ratio Z is greater than 80% by mole, any one or both of X and Y become less than 10% by mole, and it becomes difficult to impart a good combination of water-shedding property, hardness and flexibility (i.e., abrasion resistance) to the cover layer.

Specific examples of the monomers for forming the unit (C) include radically polymerizable acrylate and methacrylate compounds having an acryloyl group or a methacryloyl group. Specific examples of the acrylate and methacrylate compounds include methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino) ethyl methacrylate, 2-(diethylamino)ethyl acrylate, etc. Among these monomers, alkyl methacrylates are preferable, and methyl methacrylate is more preferable. These monomers can be used alone or in combination for forming the unit (C).

The copolymer for use in preparing the cover layer of the carrier of the present invention is a (meth)acrylic copolymer prepared by radically copolymerizing a monomer having the unit (A) and a monomer having the unit (B). Since the number of the crosslinkable functional groups of the copolymer per a unit weight of the copolymer is relatively large, and the monomer having the unit (B) is subjected to condensation polymerization so that the copolymer is crosslinked, the resultant cover layer is very tough and is hardly abraded. Therefore, the carrier of the present invention has good durability.

In addition, since the siloxane bond included in the crosslinked copolymer has a higher bond energy than a crosslinked material crosslinked by using an isocyanate compound and has good resistance to heat stresses, the cover layer can maintain good stability over a long period of time.

The cover layer coating medium for use in preparing the cover layer preferably includes a silicone resin having a silanol group and/or a functional group capable of forming a silanol group on hydrolysis. Such a silicone resin induces a condensation polymerization reaction with the unit (B) of the copolymer or a modified version of the unit (B) which is changed so as to have a silanol group on hydrolysis. In this case, the silicone resin can be incorporated in the resultant crosslinked material (cover layer), and thereby the resistance of the cover layer to the spent toner problem can be further enhanced.

The silicone resin preferably used for preparing the cover layer preferably includes at least one of the following units (3):

(3)

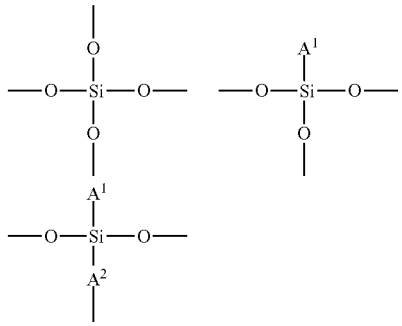

wherein $A^1$ represents a hydrogen atom, a halogen atom, a hydroxyl group, a methoxy group, an alkyl group having 1 to 4 carbon atoms or an aryl group; and $A^2$ represents an alkylene group having 1 to 4 carbon atoms or an arylene group.

Specific examples of the halogen atom include fluorine, chlorine, bromine and iodine atoms. Specific examples of the alkyl group having 1 to 4 carbon atoms include methyl, ethyl, propyl, isopropyl and butyl groups. Specific examples of the aryl group include phenyl and tolyl groups. Specific examples of the alkylene group having 1 to 4 carbon atoms include methylene, ethylene, propylene and butylene groups. Specific examples of the arylene group include phenylene and naphthylene groups.

The aryl group preferably has 6 to 20 carbon atoms, and more preferably from 6 to 14 carbon atoms. The aryl group include aryl groups (such as phenyl groups) derived from benzene, aryl groups derived from condensation polycyclic aromatic hydrocarbons (such as naphthalene, phenanthrene and anthracene), and aryl groups derived from chain polycyclic aromatic hydrocarbons (such as biphenyl and terphenyl). The aryl group optionally has a substituent.

The arylene group preferably has 6 to 20 carbon atoms, and preferably from 6 to 14 carbon atoms. The arylene group include arylene groups (such as phenylene groups) derived from benzene, arylene groups derived from condensation polycyclic aromatic hydrocarbons (such as naphthalene, phenanthrene and anthracene), and arylene groups derived from chain polycyclic aromatic hydrocarbons (such as biphenyl and terphenyl). The arylene group optionally has a substituent.

Specific examples of marketed silicone resins for use as the silicone resin include KR251, KR271, KR272, KR282, KR252, KR255, KR152, KR155, KR211, KR216 and KR213, which are from Shin-Etsu Chemical Co., Ltd.; AY42-170. SR2510, SR2400, SR2406, SR2410, SR2405 and SR2411, which are from Dow Corning Toray Silicone Co., Ltd.; etc.

As mentioned above, various kinds of silicone resins can be used. Among these silicone resins, methyl silicone resins are preferable because of having good resistance to the spent toner problem and small variation in charge quantity even when environmental conditions vary.

The weight average molecular weight of such a silicone resin is from 1,000 to 100,000, and preferably from 1,000 to 30,000. When the weight average molecular weight is greater than 100,000, the cover layer coating medium tends to have so high a viscosity that an uneven cover layer is formed or the resultant cover layer has insufficient crosslinking density. By contrast, when the weight average molecular weight is less than 1,000, the resultant cover layer tends to become brittle.

The added amount of such a silicone resin is generally from 5 to 80 parts by weight, and preferably from 10 to 60 parts by weight, based on 100 parts by weight of the copolymer used. When the added amount is smaller than 5 parts, the resistance to the spent toner problem tends to be insufficiently improved. By contrast, when the added amount is larger than 80 parts, the toughness of the cover layer tends to deteriorate, and thereby the cover layer may be easily abraded.

The cover layer of the carrier of the present invention can include a silane coupling agent to control the charging ability of charging the toner used in combination therewith and to satisfactorily disperse an optional particulate electroconductive material (mentioned below) in the cover layer coating medium. Among silane coupling agents, aminosilanes are preferable to control the charging ability thereof. Specific examples thereof include the following compounds.

| | |
|---|---|
| $H_2N(CH_2)_3Si(OCH_3)_3$ | MW = 179.3 |
| $H_2N(CH_2)_3Si(OC_2H_5)_3$ | MW = 221.4 |
| $H_2N(CH_2)_3Si(CH_3)_2(OC_2H_5)$ | MW = 161.3 |
| $H_2N(CH_2)_3Si(CH_3)(OC_2H_5)_2$ | MW = 191.3 |
| $H_2N(CH_2)_2(NH)(CH_2)Si(OCH_3)_3$ | MW = 194.3 |
| $H_2N(CH_2)_2(NH)(CH_2)_3Si(CH_3)(OCH_3)_2$ | MW = 206.4 |
| $H_2N(CH_2)_2(NH)(CH_2)_3Si(OCH_3)_3$ | MW = 224.4 |
| $(CH_3)_2N(CH_2)_3Si(CH_3)(OC_2H_5)_2$ | MW = 219.4 |
| $(C_4H_9)_2NC_3H_6Si(OCH_3)_3$ | MW = 291.6 |

The content of an aminosilane in the cover layer is preferably from 0.001 to 30 parts by weight, and more preferably from 0.1 to 20 parts by weight, based on 100 parts by weight of the silicone resin used.

The cover layer of the carrier of the present invention can include a resin other than the above-mentioned silicone resin having a silanol group and/or a hydrolysable functional group.

Specific examples of such a resin include acrylic resins, amino resins, polyvinyl resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, copolymers of vinylidene fluoride and vinyl fluoride, fluoroterpolymers such as terpolymers of tetrafluoroethylene, vinylidene fluoride and a non-fluorinated monomer, silicone resins which do not have both of a silanol group and a hydrolysable functional group, etc. These resins can be used alone or in combination. Among these resins, acrylic resins are preferable because of having good adhesion to core materials and electroconductive materials (mentioned below), and low brittleness.

Acrylic resins for use in the cover layer preferably have a glass transition temperature of from 20° C. to 100° C., and more preferably from 25° C. to 80° C. Since such acrylic resins have proper elasticity, the resultant cover layer formed on a carrier can absorb shock caused when the carrier particles are rubbed with each other and toner particles, thereby preventing the cover layer from damaging while imparting a proper charge to the developer.

The cover layer preferably includes a crosslinked material obtained by reacting an acrylic resin with an amino resin so as to have a proper elasticity and to prevent aggregation of the carrier particles due to adhesion of the cover layer to each other.

Among such amino resins, melamine resins and benzoguanamine resins are preferable because of having a good charge imparting ability, but the amino resin for use in the cover layer is not limited thereto. In a case in which the charge imparting ability of the carrier is controlled so as to be proper, it is preferable to use a combination of at least one of a melamine resin and a benzoguanamine resin, and another amino resin.

Acrylic resins capable of reacting with such amino resins as mentioned above are not particularly limited, but it is preferable to use acrylic resins having at least one of a hydroxyl group and a carboxyl group (more preferably a hydroxyl group) to further improve adhesion of the cover layer with the core material and to satisfactorily disperse a particulate electroconductive material in the cover layer due to improvement of adhesion of the resin to such a particulate electroconductive material. Such acrylic resins preferably have a hydroxyl value of not lower than 10 mgKOH, and more preferably not lower than 20 mgKOH.

The cover layer preferably includes a particulate electroconductive material to control the volume resistivity of the carrier. Specific examples of such a particulate electroconductive material include carbon blacks, indium tin oxide (ITO), tin oxide, and zinc oxide, but are not limited thereto. These electroconductive materials can be used alone or in combination.

The added amount of such an electroconductive material in the cover layer coating medium is not particularly limited, but is preferably from 0.1 parts by weight to 1,000 parts by weight based on 100 parts by weight of a silicone resin included in the cover layer coating liquid. When the added amount is less than 0.1 parts by weight, the effect of controlling the volume resistivity of the carrier cannot be satisfactorily produced. By contrast, when the added amount is greater than 1,000 parts by weight, it becomes difficult for the cover layer to bear the electroconductive material, resulting in breaking down of the cover layer.

The cover layer preferably has an average thickness of from 0.05 to 4 μm. When the average thickness is less than 0.05 μm, the cover layer tends to be easily worn out. By contrast, when the thickness is greater than 4 μm, the carrier adhesion problem tends to be caused because the magnetic property of the carrier deteriorates due to the thick cover layer, which is nonmagnetic.

The core material is not particularly limited as long as the core material is a magnetic material. Specific examples of the core material include ferromagnetic metals (e.g., iron and cobalt); iron oxides (e.g., magnetite, hematite and ferrite); ferromagnetic alloys and compounds; particulate resins in which one or more of these magnetic materials are dispersed; etc. Among these materials, manganese ferrite, manganese-magnesium ferrite and manganese-magnesium-strontium ferrite are preferable in view of environmental protection.

The core material preferably has a weight average particle diameter of from 20 μm to 65 μm. When the weight average particle diameter of the core material is less than 20 μm, the carrier adhesion problem tends to be caused. By contrast, when the weight average particle diameter is greater than 65 μm, reproducibility of fine line images tends to deteriorate, i.e., it becomes hard to produce high definition images.

The weight average particle diameter of a core material is measured by a particle size analyzer, MICROTRACK HRA9320-X100 from Nikkiso Co., Ltd.

The carrier of the present invention preferably has a magnetization of from 40 $Am^2/kg$ to 90 $Am^2/kg$ at a magnetic field of 1 kOe ($10^6/4\pi$[A/m]). When the magnetization is lower than 40 $Am^2/kg$, the carrier adhesion problem tends to be caused. By contrast, when the magnetization is greater than 90 $Am^2/kg$, the magnetic brush formed on a developer bearing member becomes too hard, thereby forming low density images. The magnetization of a carrier is measured by an instrument VSM-P7-15 from Toei Industry Co., Ltd.

The carrier of the present invention preferably has a volume resistivity of from $1\times10^9$ Ω·cm to $1\times10^{17}$ Ω·cm. When the volume resistivity is lower than $1\times10^9$ Ω·cm, carrier particles often adhere to background portions of images. By contrast, when the volume resistivity is higher than $1\times10^{17}$Ω·cm, images with strong edge effect are often produced.

The volume resistivity of a carrier is measured using a cell illustrated in FIG. 1. Specifically, a carrier 103 is contained in a cell 102, which is made of a fluorine-containing resin and which has electrodes 101*a* and 101*b*, wherein each of the electrodes has a dimension of 2.5 cm×4 cm and the distance between the electrodes is 0.2 cm. After the carrier is fed into the cell 102 so as to overflow from the cell without applying a pressure to the carrier, the cell is tapped 10 times at a tapping speed of 30 times per minute, and a nonmagnetic flat blade is slid once along the upper surface of the cell to remove the projected portion of the carrier projected from the upper surface of the cell. Next, a DC voltage of 1,000V is applied between the electrodes 101*a* and 101*b*, and the resistance r (Ω) of the carrier is measured with an instrument, HIGH RESISTANCE METER 4329A from Hewlett-Packard Japan, Ltd. The volume resistivity R(QΩcm) of the carrier is determined from the following equation (1):

$$R(\Omega\cdot\text{cm})=r(2.5\times4)/0.2 \quad (1).$$

The developer of the present invention includes the carrier mentioned above and a toner.

The toner is a monochrome toner (such as black toner) or a color toner (such as yellow, magenta and cyan toners), which includes at least a binder resin and a colorant. In order that a developer can be used for an oil-less fixing device, in which an oil for preventing adhesion of toner to the fixing member thereof is not applied, toner included in the developer may include a release agent. Such toner tends to easily cause the toner filming problem in that a toner film is formed on the surface of the carrier used in combination with the toner, thereby degrading the charging ability of the carrier. However, since the carrier of the present invention can prevent occurrence of the toner filming problem, the developer of the present invention can maintain good developing property over a long period of time even when the toner includes a release agent. In addition, when the cover layer of a carrier is abraded and the abraded cover layer is mixed with a color toner (particularly a yellow toner), the color of the color toner changes, resulting in deterioration of the color reproducibility of the developer. However, since the carrier of the present invention has good abrasion resistance, the developer of the present invention can prevent occurrence of such a color changing problem.

The method for preparing the toner for use in the developer of the present invention is not particularly limited. Specific examples of the method include pulverization methods, polymerization methods, etc.

Pulverization methods typically include the following processes:

(1) kneading toner components such as a binder resin and a colorant upon application heat and shearing force thereto;
(2) cooling the kneaded toner component mixture to solidify the mixture;
(3) pulverizing the solidified mixture;
(4) classifying the pulverized toner component mixture, thereby preparing toner particles (i.e., a mother toner); and
(5) mixing an external additive with the toner particles to improve the durability thereof, resulting in preparation of a toner.

Specific examples of the kneading machines include batch kneading machines such as two-roll mills, and BANBURY MIXER, and continuous kneaders such as twin screw extruders and single screw extruders. Specific examples of the twin screw extruders include KTK twin screw extruders from Kobe Steel, Ltd., TEM twin screw extruders from Toshiba Machine Co., Ltd., twin screw extruders from KCK Co., Ltd., PCM twin screw extruders from Ikegai Corp., KEX twin screw extruders from Kurimoto Ltd., etc. Specific examples of the single screw extruders include KO-KNEADER from Buss AG.

In the pulverization process, it is preferable to crush the solidified mixture using a crusher such as hammer mills, and cutter mills (e.g., ROATPLEX from Hosokawa Micron Corp.), and then pulverizing the crushed toner component mixture using a pulverizer such as jet air pulverizers and mechanical pulverizers. In this regard, it is preferable to perform pulverization so that the resultant toner particles have an average particle diameter of from 3 μm to 15 μm.

It is preferable to use an air classifier for the classification process. In the classification process, the toner particles are classified so as to have an average particle diameter of from 5 μm to 20 μm.

The external additive adding process is performed using a mixer so that the external additive is adhered to the surface of the toner particles while dissociated.

Specific examples of the resins for use as the binder resin of the toner include homopolymers of styrene and substituted styrene such as polystyrene, poly-p-chlorostyrene, and polyvinyl toluene; styrene copolymers such as styrene—p-chlorostyrene copolymers, styrene—propylene copolymers, styrene—vinyl toluene copolymers, styrene—methyl acrylate copolymers, styrene—ethyl acrylate copolymers, styrene—butyl acrylate copolymers, styrene—methyl methacrylate copolymers, styrene—ethyl methacrylate copolymers, styrene—butyl methacrylate copolymers, styrene—methyl α-chloromethacrylate copolymers, styrene—acrylonitrile copolymers, styrene—vinyl methyl ether copolymers, styrene—vinyl methyl ketone copolymers, styrene—butadiene copolymers, styrene—isoprene copolymers, styrene—maleic acid copolymers and styrene—maleic acid ester copolymers; acrylic resins such as polymethyl methacrylate, and polybutyl methacrylate; and other resins such as polyvinyl chloride, polyvinyl acetate, polyethylene, polypropylene, polyester, polyurethane resins, epoxy resins, polyvinyl butyral resins, polyacrylic acid resins, rosin, modified rosins, terpene resins, phenolic resins, aliphatic or alicyclic hydrocarbon resins, aromatic petroleum resins, etc. These resins are used alone or in combination.

Not only heat-fixable toner but also pressure-fixable toner can be used as the toner of the developer of the present invention. Specific examples of the resins for use as the binder resin of such pressure-fixable toner include polyolefin (e.g., low molecular weight polyethylene and low molecular weight polypropylene), ethylene—acrylic copolymers, ethylene—acrylate copolymers, ethylene—methacrylate copolymers, ethylene—vinyl chloride copolymers, ethylene—vinyl acetate copolymers, olefin copolymers (e.g. ionomer resins), epoxy resins, polyester resins, styrene—methacrylic acid copolymers, styrene—butadiene copolymers, polyvinyl pyrrolidone, methyl vinyl ether—maleic anhydride copolymers, maleic acid modified phenolic resins, phenol modified terpene resins, etc. These resins are used alone or in combination.

Various colorants such as yellow pigments, orange pigments, red pigments, violet pigments, blue pigments, green pigments, black pigments, etc. can be used for the toner used in combination with the carrier of the present invention. These colorants are used alone or in combination.

Specific examples of the yellow pigments include Cadmium Yellow, Mineral Fast Yellow, Nickel Titan Yellow, Naples Yellow, NEPHTHOL YELLOW S, HANZA YELLOW G, HANZA YELLOW 10G, BENZIDINE YELLOW GR, Quinoline Yellow Lake, PERMANENT YELLOW NCG, Tartrazine Lake, etc.

Specific examples of the orange pigments include Molybdenum Orange, PERMANENT ORANGE GTR, Pyrazolone Orange, VULVAN ORANGE, INDANTHRENE BRILLIANT ORANGE RK, BENZIDINE ORANGE G, INDANTHRENE BRILLIANT ORANGE GK, etc.

Specific examples of the red pigments include red iron oxide, cadmium red, PERMANENT RED 4R, Lithol Red, Pyrazolone Red, Watchung Red calcium salt, Lake Red D, Brilliant Carmine 6B, Eosin Lake, Rhodamine Lake B, Alizarine Lake, Brilliant Carmine 3B, etc.

Specific examples of the violet pigments include Fast Violet B, and Methyl Violet Lake, etc.

Specific examples of the blue pigments include cobalt blue, Alkali Blue, Victoria Blue Lake, Phthalocyanine Blue, metal-free Phthalocyanine Blue, partially-chlorinated Phthalocyanine Blue, Fast Sky Blue, INDANTHRENE BLUE BC, etc.

Specific examples of the green pigment include Chrome Green, chromium oxide, Pigment Green B, Malachite Green Lake, etc.

Specific examples of the black pigments include carbon black, oil furnace black, channel black, lamp black, acetylene black, azine dyes such as aniline black, metal salts of azo dyes, metal oxides, complex metal oxides, etc.

These pigments can be used alone or in combination.

Specific examples of the release agent for use in the toner include polyolefin (e.g., polyethylene and polypropylene), fatty acid metal salts, fatty acid esters, paraffin waxes, amide waxes, polyalcohol waxes, silicone varnishes, carnauba waxes, ester waxes, etc.

These release agents can be used alone or in combination.

The toner can optionally include a charge controlling agent. Suitable materials for use as the charge controlling agent include Nigrosine, azine dyes having 2 to 16 carbon atoms (disclosed in published examined Japanese patent application No. 42-1627), basic dyes, lake pigments of basic dyes, quaternary ammonium salts, dialkyltin compounds, dialkyltin borate compounds, guanidine derivatives, polyamine resins, metal complexes of monoazo dyes, salicylic acid derivatives, metal complexes of acids, sulfonated copper phthalocyanine pigments, organic boron salts, fluorine-containing quaternary ammonium salts, calixarene compounds, etc. These compounds can be used alone or in combination.

Specific examples of the basic dyes include C. I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic Blue 25 (C.I. 52025), C.I. Basic Blue 26 (C.I. 44045), C.I. Basic Green 1 (C.I. 42040), and C.I. Basic Green 4 (C.I. 42000).

Specific examples of the quaternary ammonium salts include C.I. Solvent Black 8 (C.I. 26150), benzoylmethylhexadecylammonium chloride, and decyltrimethylammonium chloride.

Specific examples of the dialkyltin compounds include dibutyltin compounds, and dioctyltin compounds.

Specific examples of the polyamine resins include vinyl polymers having an amino group, and condensation polymers having amino group.

Specific examples of the metal complexes of monoazo dyes include metal complexes of monoazo dyes disclosed in published examined Japanese patent applications Nos. (hereinafter JP-B) 41-20153, 43-27596, 44-6397, and 45-26478.

Specific examples of the salicylic acid derivatives include compounds disclosed in JP-Bs 55-42752 and 59-7385.

Specific examples of the metal complexes of acids include metal (e.g., Zn, Al, Co, Cr and Fe) complexes of dialkylsalicylic acids, naphthoic acid, and dicarboxylic acids.

Among these charge controlling agents, salicylic acid derivatives (such as metal complexes) having white color are preferably used for color toners.

Materials for use as the external additive of the toner are not particularly limited, and specific examples thereof include particulate inorganic materials (such as silica, titanium oxide, alumina, silicon carbide, silicon nitride and boron nitride), particulate resins (such as polymethyl methacrylate and polystyrene) having an average particle diameter of from 0.05 μm to 1 μm which are prepared by a soap-free emulsion polymerization method, etc. These materials are used alone or in combination.

Among these materials, metal oxides such as silica and titanium oxide, whose surface is hydrophobized, are preferable. It is more preferable to use a combination of a hydrophobized silica and a hydrophobized titanium oxide, wherein the added amount of hydrophobized silica is greater than that of the hydrophobized titanium oxide, so that the resultant toner can maintain good charge stability even when environmental humidity changes.

Next, the developer container containing the developer of the present invention will be described.

Figure 4:
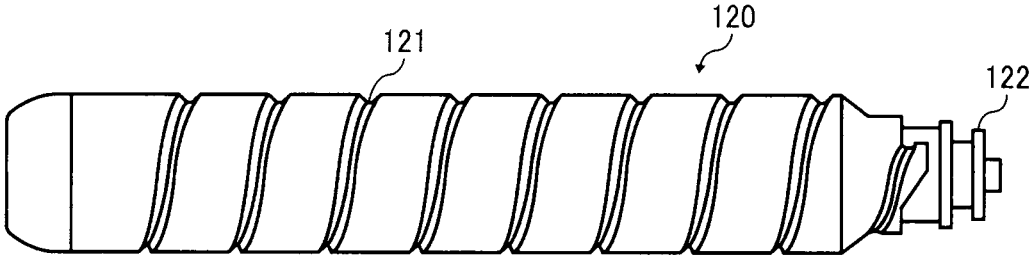
FIG. 4 is a schematic view illustrating an example of the developer container of the present invention.

The developer container contains the developer of the present invention. The shape, size and constitutional material of the developer container are not particularly limited. FIG. 4 illustrates an example of the developer container. Referring to FIG. 4, a developer container 120 containing the developer of the present invention has a spiral groove 121 (i.e., a spiral projection on the inner surface of the container), and a cap 122. After removing the cap 122 and the container is set to an image forming apparatus or a process cartridge, the developer in the container 120 is fed along the spiral projection to the entrance of the container when the container is rotated, resulting in supply of the developer to a developing device of the image forming apparatus or the process cartridge. A portion or the entire of the spiral portion may have an accordion like configuration so as to shrink as the amount of the developer therein decreases.

The constitutional material of the container is not particularly limited, but materials having good dimensional precision such as resins are preferably used. Among various resins, polyester resins, polyethylene resins, polypropylene resins, polystyrene resins, polyvinyl chloride resins, acrylic resins, polycarbonate resins, ABS resins, polyacetal resins, etc. are preferably used.

The developer container of the present invention has a good combination of preservability, transportability and handling property. The developer container can be detachably attachable to the image forming apparatus and the process cartridge described later.

Next, the image forming method and apparatus of the present invention will be described.

The image forming method of the present invention includes:

(1) an electrostatic latent image forming process in which an electrostatic latent image is formed on an image bearing member (such as a photoreceptor);
(2) a developing process in which the electrostatic latent image is developed with the developer of the present invention to form a toner image on the image bearing member;
(3) a transfer process in which the toner image on the image bearing member is transferred onto a recording material optionally via an intermediate transfer medium; and
(4) a fixing process in which the toner image is fixed to the recording material, resulting in formation of a copy.

Figure 2:
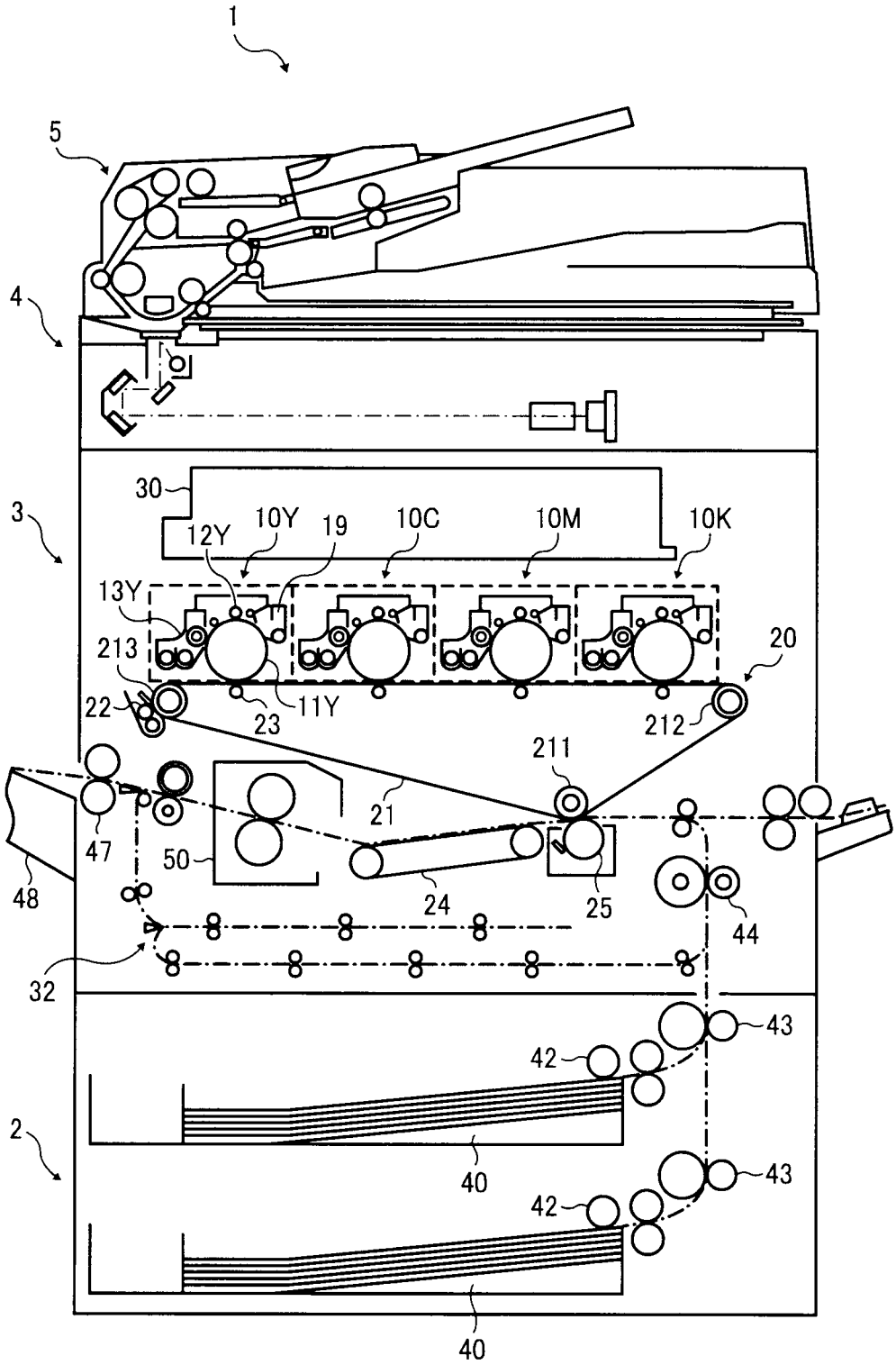
FIG. 2 is a schematic view illustrating an example of the image forming apparatus of the present invention.

FIG. 2 is a schematic view illustrating an example of the image forming apparatus of the present invention. The image forming apparatus is a tandem image forming apparatus having four image forming stations, which form different color images to form a full color image.

Referring to FIG. 2, an image forming apparatus 1 includes a document feeder 5 to feed an original document, a scanner 4 to read the image of the original document, an image processor to process image signals output from the scanner to produce digital image signals, and an image forming section 3 to form an image on a recording material based on the digital image signals.

Specifically, the image of an original document set on the document table of the scanner 4 is irradiated with light emitted by a lamp, and the optical image of the original image is read by a color CCD via a mirror and a lens. The image data is sent to the image processor. The image processor processes the image data to convert the data to image signals, and sends the image signals to the image forming section 3.

Figure 3:
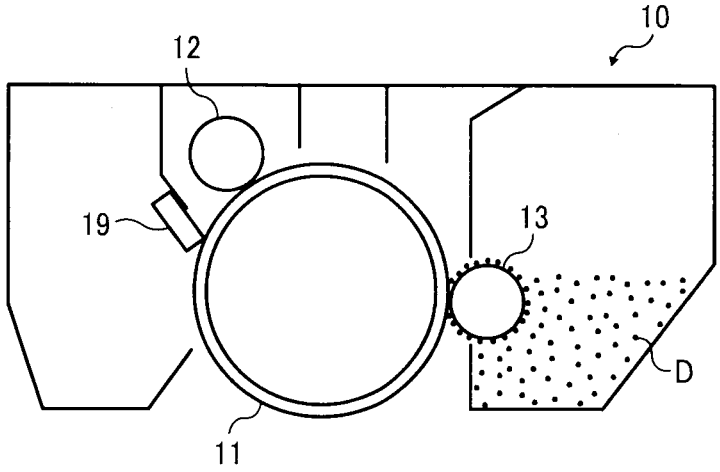
FIG. 3 is a schematic view illustrating an example of the process cartridge of the present invention.

The image forming section 3 includes four image forming stations 10Y, 10C, 10M and 10K for respectively forming yellow (Y), cyan (C), magenta (M) and black (K) toner images using respective developers including the carrier of the present invention and Y, C, M and K toners. In addition, an intermediate transfer belt 21 to receive color toner images from the image forming stations 10Y, 10C, 10M and 10K to form a combined toner image thereon, and a secondary transfer roller 25 to transfer the combined toner image to a recording material are provided below the image forming section 3. As illustrated in FIG. 3, the four image forming stations 10Y, 10C, 10M and 10K have substantially the same configuration, and reference numerals of constitutional devices are described only for the yellow image forming station 10Y. Hereinafter, the image forming operation will be described by reference to the yellow image forming station 10Y, but the same image forming operation is performed in the other image forming stations 10C, 10M and 10K unless otherwise specified.

The image forming station 10 may be a process cartridge, which can be detachably attached to the image forming apparatus 1.

When an image forming operation is ordered, a charger 12Y evenly charges the peripheral surface of a photoreceptor 11Y, which serves as an image bearing member and which includes a metal substrate electrically grounded, and a photosensitive layer formed on the peripheral surface of the metal substrate so that the surface of the photoreceptor has a negative charge. The charging operation is performed, for example, using corona-charging. Next, an irradiator 30 including a laser diode irradiates the charged surface of the photoreceptor 11Y based on image signals for a yellow (Y) image to form an electrostatic latent image on the surface of the photoreceptor.

A developing device 13Y develops the electrostatic latent image for the Y image with a developer including the carrier of the present invention and a yellow toner, thereby forming a yellow toner image on the surface of the photoreceptor 11Y. Similarly, cyan, magenta and black toner images are sequentially formed on respective photoreceptors 11.

The thus prepared Y, C, M and K toner images are sequentially transferred onto the intermediate transfer belt 21 by primary transfer rollers 23, which are provided on the backside of the intermediate transfer belt and to each of which a predetermined transfer bias is applied. Thus, a combined color toner image, in which the Y, C, M and K toner images are overlaid, is prepared on the intermediate transfer belt 21.

After transferring the toner image, the photoreceptor 11 of each image forming station 10 is discharged with an optical discharging unit (not shown) and residual toner remaining on the surface of the photoreceptor is removed with a cleaner 19 so that the photoreceptor is ready for the next image forming operation. Specifically, a brush roller of the cleaner 19 is rotated in such a direction as to counter the rotated photoreceptor 11 to disturb residual toner on the photoreceptor, thereby weakening the adhesion of the residual toner to the photoreceptor, and a blade of the cleaner is contacted with the surface of the photoreceptor to remove the disturbed residual toner from the surface of the photoreceptor. The toner collected by the cleaner 19 is fed to a waste toner container via a waste toner feeding passage.

After a combined color toner image is transferred from the intermediate transfer belt 21 to a recording material, the surface of the intermediate transfer belt is cleaned with a belt cleaner 22 such as brushes and blades to remove foreign materials such as paper dusts and residual toner therefrom. The foreign materials collected by the belt cleaner are also fed to the waste toner container. The intermediate transfer belt 21, the primary transfer rollers 23, the secondary transfer roller 25, the belt cleaner 22, a transfer bias power source for applying a transfer bias to the primary and secondary transfer rollers, a driving shaft and tension rollers 211, 212 and 213 constitute a transfer device 20. The tension rollers 211, 212 and 213 apply or release a tension to or from the intermediate transfer belt 21 using a cam mechanism so that the intermediate transfer belt is attached to or detached from the photoreceptors 11. Specifically, before the photoreceptors 11 are rotated, the intermediate transfer belt 21 is attached to the photoreceptors, and when the image forming apparatus is stopped, the intermediate transfer belt 21 is detached from the photoreceptors. After a combined color toner image is transferred from the intermediate transfer belt 21 to a recording material, the intermediate transfer belt is discharged with an optical discharging unit.

The combined color toner image on the intermediate transfer belt 21 is then transferred onto a recording material sheet, which is timely fed to the secondary transfer position, by the secondary transfer roller 25 to which a predetermined transfer bias is applied.

The recording material sheets, which are contained in plural cassettes 40 in a sheet feeding device 2, are fed from one of the cassettes one by one by a pickup roller 42. The recording material sheet thus picked up is fed to the image forming section 3 by a feed roller 43. The recording material sheet is stopped once by a registration roller 44, and then timely fed to the secondary transfer position, i.e., a nip between the intermediate transfer belt 21 and the secondary transfer roller 25 so that the combined color toner image is transferred from the intermediate transfer belt to the recording material sheet.

The recording material sheet bearing the combined color toner image is then fed to a fixing device 50 to fix the combined color toner image, resulting in fixation of the image on the recording material sheet. Thus, a full color image is formed and is discharged to a copy tray 48 by a discharging roller 47.

When a duplex copy is prepared, the recording material sheet passing the fixing device 50 and bearing an image on one side thereof is not fed to the copy tray 48 and is returned to the registration roller 44 via a feeding portion 32 so that another toner image is transferred to the other side of the recording material sheet at the secondary transfer position.

The developing device 13 has a development sleeve, which includes a magnetic field generating member therein and which is opposed to the photoreceptor 11.

The charger 12 has a charging roller, which serves as a charging member and which is contacted with or is arranged so as to be close to the surface of the photoreceptor 11 to apply a predetermined voltage to the photoreceptor, thereby charging the photoreceptor.

The cleaner 19 has not only the cleaning brush and blade, but also a collection blade of film (not shown) for collecting the residual toner gathered by the cleaning blade, and a coil for feeding the collected toner. The cleaning blade is made of a material such as metals, resins, and rubbers. Among these materials, rubbers such as fluorine containing rubbers, silicone rubbers, butyl rubbers, butadiene rubbers, isoprene rubbers, and urethane rubbers are preferable, and urethane rubbers are more preferable.

The image forming apparatus optionally includes a lubricant applicator to apply a lubricant such as fluorine-containing resins silicone resins, and stearic acid metal salts (e.g., zinc stearate, and aluminum stearate) to the surface of the photoreceptor 11.

In FIG. 2, reference numeral 24 denotes a feeding belt to feed the recording material sheet bearing the toner image to the fixing device 50.

The image forming station 10 may be a process cartridge. The process cartridge of the present invention includes at least an image bearing member to bear an electrostatic latent image, and a developing device to develop the electrostatic latent image on the image bearing member with the developer of the present invention to form a toner image on the image bearing member, wherein the image bearing member and the developing device are integrated into a single unit.

FIG. 3 is a schematic view illustrating an example of the process cartridge of the present invention.

Referring to FIG. 3, the process cartridge 10 includes the photoreceptor 11 serving as an image bearing member, the charger 12 to charge the photoreceptor, the developing device 13 to develop an electrostatic latent image, which is formed on the photoreceptor by irradiating the charged photoreceptor with light emitted from the irradiating device 30, with a developer D of the present invention to form a toner image on the photoreceptor, and the cleaner 19 to clean the surface of the photoreceptor after the toner image on the photoreceptor is transferred. These devices are integrated, and the process cartridge can be detachably attachable to an image forming apparatus such as copiers, printers and facsimile machines.

It is preferable for the image forming apparatus of the present invention that a supplementary developer including a toner and the carrier of the present invention is fed to the developing device while part of the developer (i.e., excess of the developer) in the developing device is discharged therefrom. By using this developing method, high quality images can be stably formed over a long period of time because slightly deteriorated carrier in the developing device is replaced with the new carrier included in the supplementary developer, resulting in stabilization of charge quantity of the toner in the developer. This developing method is particularly preferable when forming images with high image area ratio. Specifically, when forming images with high image area ratio, spent toner tends to be easily formed on the surface of the carrier, thereby deteriorating the charging ability of the carrier. By using the developing method, the deteriorated carrier is replaced with the new carrier included in the supplementary developer. In addition, when forming images with high image area ratio, the amount of the supplementary developer increases, and thereby the amount of the carrier supplied to the developing device is also increased. Therefore, the carrier in the developing device can be frequently replaced with the new carrier. Accordingly, high quality images can be stably produced over a long period of time.

The weight ratio (C/T) of the carrier (C) to the toner (T) in the supplementary developer is preferably from 1/2 to 1/50. When the weight ratio (C/T) is greater than 1/2, the amount of the carrier supplied to the developer is too large, thereby excessively increasing the concentration of the carrier in the developer in the developing device, resulting impairment of too high a charge quantity to the toner. In this case, the developing ability of the developer deteriorates, thereby forming low density images. By contrast, when the weight ratio (C/T) is less than 1/50, the amount of the carrier supplied to the developer is too small, and thereby the replacement ratio of the carrier in the developing device is decreased. Therefore, the effect of the developing method is hardly produced. The supplementary developer is contained, for example, in the developer container 120 illustrated in FIG. 4, and is fed to the developing device 13.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

In the below-mentioned Copolymer Synthesis Examples and Comparative Examples, the weight average molecular weight is the standard polystyrene conversion weight average molecular weight determined by gel permeation chromatography. The viscosity was determined at 25° C. using the method defined in JIS K2283. The nonvolatile content was determined by the following method:

(1) one (1) gram (W1) of a coating liquid is fed into an aluminum dish, which is preliminarily weighed;

(2) the coating liquid is heated for 1 hour at 150° C.; and (3) the combination of the aluminum dish and the dried coating liquid is weighed to determine the weight (W2) of the dried coating liquid.

The nonvolatile content (C) is obtained by the following equation:

$$C(\%)=(W2/W1)\times 100$$

Copolymer Synthesis Example 1

Unit A/Unit B=5/5

At first, 500 g of toluene was fed into a flask equipped with an agitator, and heated to 90° C. under a nitrogen gas flow. Next, a mixture of the following components was dropped into the flask over 1 hour.

| | |
|---|---|
| 3-Methacryloxypropyltris(trimethylsiloxy)silane (i.e., component A) ($CH_2$═CMe—COO—$C_3H_6$—Si($OSiMe_3$)$_3$, SILAPLANE TM-0701T from Chisso Corp.) | 211 g (500 mmole) |
| 3-Methacryloxypropyltrimethoxysilane (i.e., component B) ($CH_2$═CMe—COO—$C_3H_6$—Si(OMe)$_3$, | 124 g (500 mmole) |
| 2,2'-Azobis-2-methylbutylonitrile (catalyst) | 0.58 g (3 mmole) |

Next, a solution of the catalyst which had been prepared by dissolving 0.06 g (0.3 mmole) of 2,2'-azobis-2-methylbutylonitrile in 15 g of toluene was fed into the flask (i.e., the total added amount of 2,2'-azobis-2-methylbutylonitrile is 0.64 g (3.3 mmole)). The mixture was heated for 3 hours in a temperature range of from 90 to 100° C. to perform a radical polymerization reaction. Thus, a solution of a methacrylic copolymer (hereinafter referred to as methacrylic copolymer 1) in which the molar ratio (A/B) of the component A to the component B is 5/5 was prepared.

The weight average molecular weight of the methacrylic copolymer 1 was 35,000.

The solution was diluted with toluene so that the non-volatile content of the solution is 25% by weight. The viscosity of the diluted solution of the methacrylic copolymer 1 was 8.5 $mm^2/s$, and the specific gravity thereof was 0.91.

Copolymer Synthesis Example 2

Unit A/Unit B=5/5

The procedure for preparation of the methacrylic copolymer 1 in Copolymer Synthesis Example 1 was repeated except that 124.0 g (500 mmole) of the component B, 3-methacryloxypropyltrimethoxysilane, was replaced with 130 g (500 mmole) of 3-methacryloxypropylmethyldiethoxysilane ($CH_2$═CMe—COO—$C_3H_6$—SiMe($OEt$)$_2$). Thus, a solution of a methacrylic copolymer 2 in which the molar ratio (A/B) of the unit A to the unit B is 5/5 was prepared.

The weight average molecular weight of the methacrylic copolymer 2 was 33,000.

The solution was diluted with toluene so that the non-volatile content of the solution is 25% by weight. The viscosity of the diluted solution of the methacrylic copolymer 2 was 8.6 $mm^2/s$, and the specific gravity thereof was 0.92.

Copolymer Synthesis Example 3

Unit A/Unit B=9/1

The procedure for preparation of the methacrylic copolymer 1 in Copolymer Synthesis Example 1 was repeated except that the added amount of the component A (3-methacryloxypropyltris(trimethylsiloxy)silane) was changed from 211 g (500 mmole) to 379.8 g (900 mmole), and added amount of the component B (3-methacryloxypropyltrimethoxysilane) was changed from 124.0 (500 mmole) to 24.8 g (100 mmole). Thus, a solution of a methacrylic copolymer 3 in which the molar ratio (A/B) of the unit A to the unit B is 9/1 was prepared.

The weight average molecular weight of the methacrylic copolymer 3 was 37,000.

The solution was diluted with toluene so that the non-volatile content of the solution is 25% by weight. The viscosity of the diluted solution of the methacrylic copolymer 3 was 8.4 $mm^2/s$, and the specific gravity thereof was 0.92.

Copolymer Synthesis Example 4

Unit A/Unit B=1/9

The procedure for preparation of the methacrylic copolymer 1 in Copolymer Synthesis Example 1 was repeated except that the added amount of the component A (3-methacryloxypropyltris(trimethylsiloxy)silane) was changed from 211 g (500 mmole) to 42.2 g (100 mmole), and added amount of the component B (3-methacryloxypropyltrimethoxysilane) was changed from 124.0 (500 mmole) to 223.2 g (900 mmole). Thus, a solution of a methacrylic copolymer 4 in which the molar ratio (A/B) of the unit A to the unit B is 1/9 was prepared.

The weight average molecular weight of the methacrylic copolymer 4 was 34,000.

The solution was diluted with toluene so that the non-volatile content of the solution is 25% by weight. The viscosity of the diluted solution of the methacrylic copolymer 4 was 8.7 $mm^2/s$, and the specific gravity thereof was 0.90.

Copolymer Synthesis Example 5

The procedure for preparation of the methacrylic copolymer 1 in Copolymer Synthesis Example 1 was repeated except that the component A (3-methacryloxypropyltris(trimethylsiloxy)silane) was replaced with 168.5 g (250 mmole) of another component A 4-acryloxybutyltris(tripropylsiloxy) silane having formula $CH_2$═CH—COO—$C_4H_8$—Si(OS-i$Pr_3$)$_3$, wherein Pr represents a propyl group, and the component B (3-methacryloxypropyltrimethoxysilane) was replaced with 83 g (250 mmole) of another compound B 3-methacryloxypropyltriisopropoxysilane having formula $CH_2$═$CCH_3$—COO—$C_3H_6$—Si($OPr$)$_3$. Thus, a solution of a methacrylic copolymer 5 in which the molar ratio (A/B) of the unit A to the unit B is 5/5 was prepared.

The weight average molecular weight of the methacrylic copolymer 5 was 39,000.

The solution was diluted with toluene so that the non-volatile content of the solution is 25% by weight. The viscosity of the diluted solution of the methacrylic copolymer 5 was 8.9 $mm^2/s$, and the specific gravity thereof was 0.94.

Copolymer Synthesis Example 6

Unit A/Unit B/unit C=2/1.5/6.5

The procedure for preparation of the methacrylic copolymer 1 in Copolymer Synthesis Example 1 was repeated except that the added amount of toluene was changed from 500 g to 300 g, the added amount of the component A (3-methacryloxypropyltris(trimethylsiloxy)silane) was changed from 211 g (500 mmole) to 84.4 g (200 mmole), the added amount of the component B (3-methacryloxypropyltrimethoxysilane) was changed from 124.0 g (500 mmole) to 37.2 g (150 mmole), and 65.0 g (650 mmole) of a component C, methylmethacrylate ($CH_2$═CMe—COOMe), was added. Thus, a solution of a methacrylic copolymer 6 in which the molar ratio (A/B/C) of the unit A and the unit B to the unit C is 2/1.5/6.5 was prepared.

The weight average molecular weight of the methacrylic copolymer 6 was 34,000.

The solution was diluted with toluene so that the non-volatile content of the solution is 25% by weight. The viscosity of the diluted solution of the methacrylic copolymer 6 was 8.7 $mm^2/s$, and the specific gravity thereof was 0.91.

Copolymer Synthesis Comparative Example 1

Unit A/Unit B=10/0

The procedure for preparation of the methacrylic copolymer 1 in Copolymer Synthesis Example 1 was repeated except that the added amount of the component A (3-methacryloxypropyltris(trimethylsiloxy)silane) was changed from 211 g (500 mmole) to 422 g (1.000 mmole), and the component B (3-methacryloxypropyltrimethoxysilane) was not added. Thus, a solution of a comparative methacrylic copolymer 1 in which the molar ratio (A/B) of the unit (A) to the unit (B) is 10/0 was prepared.

The weight average molecular weight of the comparative methacrylic copolymer 1 was 37,000.

The solution was diluted with toluene so that the non-volatile content of the solution is 25% by weight. The viscosity of the diluted solution of the comparative methacrylic copolymer 1 was 8.4 $mm^2/s$, and the specific gravity thereof was 0.91.

Copolymer Synthesis Comparative Example 2

Unit A/Unit B=0/10

The procedure for preparation of the methacrylic copolymer 1 in Copolymer Synthesis Example 1 was repeated except that the added amount of the component A (3-methacryloxypropyltris(trimethylsiloxy)silane) was not added, and the component B (3-methacryloxypropyltrimethoxysilane) was changed from 124 g (500 mmole) to 248 g (1.000 mmole). Thus, a solution of a comparative methacrylic copolymer 2 in which the molar ratio (A/B) of the unit (A) to the unit (B) is 0/10 was prepared.

The weight average molecular weight of the comparative methacrylic copolymer 2 was 33,000.

The solution was diluted with toluene so that the non-volatile content of the solution is 25% by weight. The viscosity of the diluted solution of the comparative methacrylic copolymer 2 was 8.7 $mm^2/s$, and the specific gravity thereof was 0.90.

Copolymer Synthesis Comparative Example 3

One hundred (100) parts of methyl ethyl ketone was fed into a 500 ml flask equipped with an agitator, a condenser, a thermometer, a nitrogen feed pipe and a dropping funnel. In addition, the following components were mixed to prepare a solution.

| | |
|---|---|
| Methyl methacrylate | 32.6 parts |
| 2-Hydroxyethyl methacrylate | 2.5 parts |
| 3-Methacryloxypropyltris(trimethylsiloxy)silane | 64.9 parts |
| 1,1'-azobis (cyclohexane-1-carbonitrile) (V-40 from Wako Pure Chemical Industries, Ltd.) | 1 part |
| Methyl ethyl ketone | 100 parts |

The solution was dropped into the flask over 2 hours while the flask was heated to 80° C. under a nitrogen gas flow, followed by aging for 5 hours to perform a polymerization reaction.

The solution was diluted with methyl ethyl ketone so that the non-volatile content of the solution is 25% by weight. Thus, a solution of a comparative methacrylic copolymer 3 was prepared.

Copolymer Synthesis Comparative Example 4

Unit A/Unit C=5/5

The procedure for preparation of the methacrylic copolymer 1 in Copolymer Synthesis Example 1 was repeated except that the component B (3-methacryloxypropyltrimethoxysilane) was replaced with 50 g (500 mmole) of methyl methacrylate (serving as a component C). Thus, a solution of a comparative methacrylic copolymer 4 in which the molar ratio (A/C) of the unit A to the unit C is 5/5 was prepared.

The weight average molecular weight of the comparative methacrylic copolymer 4 was 34,000.

The solution was diluted with toluene so that the non-volatile content of the solution is 25% by weight. The viscosity of the diluted solution of the comparative methacrylic copolymer 4 was 8.7 $mm^2/s$, and the specific gravity thereof was 0.91.

Copolymer Synthesis Comparative Example 5

Unit B/Unit C=5/5

The procedure for preparation of the methacrylic copolymer 1 in Copolymer Synthesis Example 1 was repeated except that the component A (3-methacryloxypropyltris(trimethylsiloxy)silane) was replaced with 50 g (500 mmole) of methyl methacrylate (serving as a component C). Thus, a solution of a comparative methacrylic copolymer 5 in which the molar ratio (B/C) of the unit B to the unit C is 5/5 was prepared.

The weight average molecular weight of the comparative methacrylic copolymer 5 was 32,000.

The solution was diluted with toluene so that the non-volatile content of the solution is 25% by weight. The viscosity of the diluted solution of the comparative methacrylic copolymer 5 was 8.5 $mm^2/s$, and the specific gravity thereof was 0.89.

Carrier Preparation Example 1

The following components were mixed to prepare a cover layer coating medium having a solid content of 10% by weight.

| | |
|---|---|
| Methacrylic copolymer 1 prepared above | 100 parts |
| Zirconium tetraacetylacetonate (catalyst, ZC-150 from Matsumoto Fine Chemical Co., Ltd., solid content of 99% by weight) | 4 parts |
| Toluene | balance |

The above-prepared cover layer coating medium was applied to a particulate manganese ferrite serving as a core material and having a weight average particle diameter of 35 μm, followed by drying at 70° C., using a fluidized bed coating device so that the dried cover layer formed on the manganese ferrite has an average thickness of 0.20 μm.

The coated carrier was then heated for 2 hours at 180° C. using an electric furnace.

Thus, a carrier A was prepared.

Carrier Preparation Examples 2 to 4

The procedure for preparation of the carrier A in Carrier Preparation Example 1 was repeated except that the methacrylic copolymer 1 was replaced with each of the methacrylic copolymers 2-4 prepared above.

Thus, carriers B, C and D were prepared.

Carrier Preparation Example 5

The procedure for preparation of the carrier A in Carrier Preparation Example 1 was repeated except that the catalyst was replaced with 5.7 parts of zirconium dibutoxybis(ethylacetoacetate) (ZC-580 from Matsumoto Fine Chemical Co., Ltd., solid content of 70% by weight).

Thus, a carrier E was prepared.

Carrier Preparation Example 6

The procedure for preparation of the carrier A in Carrier Preparation Example 1 was repeated except that the catalyst was replaced with 5.4 parts of zirconium tetra-n-propoxide (ZA-40 from Matsumoto Fine Chemical Co., Ltd., solid content of 74% by weight).

Thus, a carrier F was prepared.

Carrier Preparation Example 7

The procedure for preparation of the carrier A in Carrier Preparation Example 1 was repeated except that the catalyst was replaced with 4.9 parts of zirconium tributoxymonostearate (ZB-320 from Matsumoto Fine Chemical Co., Ltd., solid content of 81% by weight).

Thus, a carrier G was prepared.

Carrier Preparation Example 8

The procedure for preparation of the carrier A in Carrier Preparation Example 1 was repeated except that the added amount of the catalyst (zirconium tetraacetylacetonate) was changed from 4 parts to 0.5 parts.

Thus, a carrier H was prepared.

Carrier Preparation Example 9

The procedure for preparation of the carrier A in Carrier Preparation Example 1 was repeated except that the added amount of the catalyst (zirconium tetraacetylacetonate) was changed from 4 parts to 20 parts.

Thus, a carrier I was prepared.

Carrier Preparation Examples 10 and 11

The procedure for preparation of the carrier A in Carrier Preparation Example 1 was repeated except that the methacrylic copolymer 1 was replaced with each of the methacrylic copolymers 5 and 6 prepared above.

Thus, carriers J and K were prepared.

Carrier Preparation Comparative Examples 1 and 2

The procedure for preparation of the carrier A in Carrier Preparation Example 1 was repeated except that the methacrylic copolymer 1 was replaced with each of the comparative methacrylic copolymers 1 and 2 prepared above.

Thus, carriers L and M were prepared.

Carrier Preparation Comparative Example 3

The 25% solution of comparative methacrylic copolymer 3 prepared above was mixed with a catalyst, isophorone diisocyanate/trimethylolpropane adduct including an isocyanate group in an amount of 6.1% so that the molar ratio OH/NCO of the hydroxyl group of the comparative methacrylic copolymer 3 to the isocyanate group of the catalyst is 1/1. The mixture was diluted with methyl ethyl ketone so as to have a solid content of 3% by weight.

The above-prepared cover layer coating medium was applied to a particulate manganese ferrite serving as a core material and having a weight average particle diameter of 35 μm, followed by drying at 70° C., using a fluidized bed coating device so that the dried cover layer formed on the manganese ferrite has an average thickness of 0.20 μm.

The coated carrier was then heated for 1 hour at 160° C. using an electric furnace.

Thus, a carrier N was prepared.

Carrier Preparation Comparative Examples 4 and 5

The procedure for preparation of the carrier A in Carrier Preparation Example 1 was repeated except that the methacrylic copolymer 1 was replaced with each of the comparative methacrylic copolymers 4 and 5 prepared above.

Thus, carriers O and P were prepared.

The carriers A-P prepared above were evaluated by the following methods.

1. Weight Average Particle Diameter (Dw) of Core Material

The weight average particle diameter of a core material is measured using a particle size analyzer, MICROTRACK HRA9320-X100 from Nikkiso Co., Ltd.

2. Magnetization (M) at Magnetic Field of 1 kOe

The magnetization of each carrier is measured by an instrument VSM-P7-15 from Toei Industry Co., Ltd. Specifically, about 0.15 g of a carrier is fed into a cell having an inner diameter of 2.4 mm and a height of 8.5 mm, and the magnetization of the carrier is measured by the instrument at a magnetic field of 1 kOe.

3. Volume Resistivity (R)

The volume resistivity is measured using a cell illustrated in FIG. 1. The method for measuring the volume resistivity of a carrier is mentioned above.

4. Average Thickness (H) of Cover Layer

The cross sections of particles of a carrier are observed with a transmission electron microscope (TEM) to determine thicknesses of 20 points of the resinous portions of the cover layer.

The average thickness (h) (in units of micrometer) of the cover layer is determined by averaging the 20 thickness data thus obtained.

The results are shown in Table 1.

TABLE 1

| Carrier | Copolymer used for cover layer | Weight average particle diameter (Dw) (μm) | Magnetization (M) ($Am^2/kg$) | Volume resistivity (logR (Ω · cm)) | Thickness of cover layer (μm) |
|---|---|---|---|---|---|
| Ex. 1 (carrier A) | Copolymer 1 | 36.0 | 62 | 15.5 | 0.21 |
| Ex. 2 (carrier B) | Copolymer 2 | 35.9 | 62 | 15.6 | 0.20 |
| Ex. 3 (carrier C) | Copolymer 3 | 36.1 | 62 | 15.7 | 0.21 |
| Ex. 4 (carrier D) | Copolymer 4 | 36.1 | 62 | 15.4 | 0.20 |

TABLE 1-continued

| Carrier | Copolymer used for cover layer | Weight average particle diameter (Dw) (μm) | Magnetization (M) ($Am^2/kg$) | Volume resistivity (logR (Ω · cm)) | Thickness of cover layer (μm) |
|---|---|---|---|---|---|
| Ex. 5 (carrier E) | Copolymer 1 | 36.1 | 62 | 15.4 | 0.20 |
| Ex. 6 (carrier F) | Copolymer 1 | 36.0 | 62 | 15.7 | 0.21 |
| Ex. 7 (carrier G) | Copolymer 1 | 36.0 | 62 | 15.5 | 0.20 |
| Ex. 8 (carrier H) | Copolymer 1 | 36.1 | 62 | 15.2 | 0.21 |
| Ex. 9 (carrier I) | Copolymer 1 | 36.0 | 62 | 15.3 | 0.20 |
| Ex. 10 (carrier J) | Copolymer 5 | 36.0 | 62 | 15.4 | 0.20 |
| Ex. 11 (carrier K) | Copolymer 6 | 36.0 | 62 | 15.3 | 0.21 |
| Comp. Ex. 1 (carrier L) | Comp. Copolymer 1 | 35.8 | 62 | 15.7 | 0.21 |
| Comp. Ex. 2 (carrier M) | Comp. Copolymer 2 | 36.2 | 62 | 15.4 | 0.20 |
| Comp. Ex. 3 (carrier N) | Comp. Copolymer 3 | 36.2 | 62 | 15.3 | 0.19 |
| Comp. Ex. 4 (carrier O) | Comp. Copolymer 4 | 36.0 | 62 | 15.5 | 0.21 |
| Comp. Ex. 5 (carrier P) | Comp. Copolymer 5 | 36.0 | 62 | 15.4 | 0.20 |

Toner Preparation Example

1. Preparation of Polyester Resin A

The following components were fed into a reaction vessel equipped with a thermometer, an agitator, a condenser and a nitrogen feed pipe to be mixed.

| | |
|---|---|
| Propylene oxide adduct of bisphenol A (having hydroxyl value of 320 mmKOH/g) | 443 parts |
| Diethylene glycol | 135 parts |
| Terephthalic acid | 422 parts |
| Dibutyltin oxide | 2.5 parts |

The mixture was heated to 200° C. to be reacted. When the acid value of the reaction product reached 10 mgKOH/g, the reaction was stopped. Thus, a polyester resin A was prepared. It was confirmed that the polyester resin A has a glass transition temperature of 63° C. and a peak number average molecular weight of 6,000.

2. Preparation of Polyester Resin B

The following components were fed into a reaction vessel equipped with a thermometer, an agitator, a condenser and a nitrogen feed pipe to be mixed.

-continued

| | |
|---|---|
| Propylene oxide adduct of bisphenol A (having hydroxyl value of 320 mmKOH/g) | 443 parts |
| Diethylene glycol | 135 parts |
| Terephthalic acid | 422 parts |
| Dibutyltin oxide | 2.5 parts |

The mixture was heated to 230° C. to be reacted. When the acid value of the reaction product reached 7 mgKOH/g, the reaction was stopped. Thus, a polyester resin B was prepared. It was confirmed that the polyester resin B has a glass transition temperature of 65° C. and a peak number average molecular weight of 16,000.

3. Preparation of Mother Toner

The following components were mixed for 3 minutes using a HENSCHELMIXER mixer (HENSCHEL 20B from Mitsui Mining & Smelting Co., Ltd.) whose rotor was rotated at a revolution of 1,500 rpm.

| | |
|---|---|
| Polyester resin A prepared above | 40 parts |
| Polyester resin B prepared above | 60 parts |
| Carnauba wax | 1 part |
| Carbon black (#44 from Mitsubishi Chemical Corp.) | 15 parts |

The mixture was kneaded using a single screw extruder, KO-KNEADER from Buss AG. The kneading conditions were as follows.

Preset temperature at entrance of the kneader: 100° C.

Preset temperature at exit of the kneader: 50° C.

Feed rate of mixture to be kneaded: 2 kg/hour

Thus, a kneaded toner component mixture A1 was prepared.

After being subjected to roll cooling, the kneaded toner component mixture A1 was pulverized using a pulverizer, followed by fine pulverization using an I-type mill (IDS-2 from Nippon Pneumatic Mfg. Co., Ltd.) having a flat collision plate, and classification using a classifier (132 MP from Alpine AG.). The fine pulverization conditions were as follows.

Pressure of air: 6.8 atm/$cm^2$

Feed rate of mixture to be pulverized: 0.5 kg/hour

Thus, a mother toner 1 was prepared.

4. Addition of External Additive

The following components were mixed using a HENSCHEL MIXER mixer.

| | |
|---|---|
| Mother toner 1 prepared above | 100 parts |
| Hydrophobized silica (R972 from Nippon Aerosil Co. ltd.) | 1.0 part |

Thus, a toner 1, which has an average particle diameter of 7.2 μm, was prepared.

Developer Preparation Examples 1-11 and Developer Preparation Comparative Examples 1-5

Ninety three (93) parts of each of the carriers A-P prepared above was mixed with 7.0 parts of the toner 1, and the mixture was subjected to ball milling for 20 minutes to prepare developers A-P for developing electrostatic images (i.e., developers of Developer Preparation Examples 1-11 and developers of Developer Preparation Comparative Examples 1-5).

The above-prepared developers A-P were evaluated as follows.

1. Charge Quantity (Q)

The initial charge quantity (Q1) of each of the developers A-P was measured with a blow-off type charge quantity measuring device (TB-200 from Toshiba Chemical Corp.).

Specifically, after a running test in which 100,000 copies of an A-4 size original image having an image area ratio of 20% are produced was performed using each developer and an image forming apparatus, IMAGIO NEO C600 from Ricoh Co., Ltd., the charge quantity (Q2) of the developer was also measured with the blow-off type charge quantity measuring device to determine the charge quantity difference |Q1−Q2|.

In this regard, the charge quantity difference |Q1−Q2| is preferably not greater than 10 μC/g. When the charge quantity difference is not greater than 10 μC/g, high quality images can be produced over a long period of time without causing the background development problem and the toner scattering problem.

2. Volume Resistivity (R) and Background Development

The initial logarithmic volume resistivity (logR1) of each of the carriers A-P was measured by the method mentioned above.

After the running test in which 100,000 copies of an A-4 size original image having an image area ratio of 20% are produced was performed using each developer and an image forming apparatus, IMAGIO NEO C600 from Ricoh Co., Ltd., the logarithmic volume resistivity (logR2) of the carrier in the developer used for the running test was also measured to determine the logarithmic volume resistivity difference (logR1)−(logR2).

In this regard, the volume resistivity difference |(logR1)−(logR2)| is preferably not greater than 1.5. When the volume resistivity difference is not greater than 1.5 log Ω·cm, high quality images can be produced without causing the carrier adhesion problem in that carrier particles adhere to a solid image.

The evaluation results are shown in Table 2.

TABLE 2

| Developer | Q1 (−μC/g) | Q2 (−μC/g) | Q1 − Q2 (−μC/g) | logR1 (Ω · cm) | logR2 (Ω · cm) | logR1 − logR2 (Ω · cm) |
|---|---|---|---|---|---|---|
| Ex. 1 (developer A) | 35 | 34 | 1 | 15.5 | 15.1 | 0.4 |
| Ex. 2 (developer B) | 38 | 34 | 4 | 15.6 | 14.9 | 0.7 |
| Ex. 3 (developer C) | 45 | 39 | 6 | 15.7 | 14.9 | 0.8 |
| Ex. 4 (developer D) | 34 | 30 | 4 | 15.4 | 16.3 | −0.9 |
| Ex. 5 (developer E) | 36 | 34 | 2 | 15.4 | 14.7 | 0.7 |
| Ex. 6 (developer F) | 36 | 31 | 5 | 15.7 | 15.0 | 0.7 |
| Ex. 7 (developer G) | 35 | 31 | 4 | 15.5 | 14.7 | 0.8 |
| Ex. 8 (developer H) | 38 | 31 | 7 | 15.2 | 13.9 | 1.3 |
| Ex. 9 (developer I) | 35 | 27 | 8 | 15.3 | 15.0 | 0.3 |
| Ex. 10 (developer J) | 36 | 34 | 2 | 15.4 | 14.9 | 0.5 |
| Ex. 11 (developer K) | 35 | 32 | 3 | 15.3 | 14.9 | 0.4 |
| Comp. Ex. 1 (developer L) | 45 | 32 | 13 | 15.7 | 13.8 | 1.9 |
| Comp. Ex. 2 (developer M) | 39 | 25 | 14 | 15.4 | 16.6 | −1.2 |
| Comp. Ex. 3 (developer N) | 38 | 21 | 17 | 15.3 | 16.6 | −1.3 |
| Comp. Ex. 4 (developer 0) | 44 | 32 | 12 | 15.5 | 12.9 | 2.6 |
| Comp. Ex. 5 (developer P) | 45 | 31 | 14 | 15.4 | 16.0 | −0.6 |

Referring to Table 2, both the charge quantity difference Q1−Q2 and the volume resistivity difference |(logR1)−(logR2)| of each of the developers of Examples 1-11 fall in the preferable ranges, and at least one of the charge quantity difference Q1−Q2 and the volume resistivity difference |(logR1)−(logR2)| of each of the comparative developers of Comparative Examples 1-5 falls out of the preferable range.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 2010-060071 and 2010-198627 filed on Mar. 17, 2010 and Sep. 6, 2010, respectively, the entire contents of which are herein incorporated by reference.

What is claimed is:

1. A carrier for use in a two-component developer for developing an electrostatic latent image, comprising a particulate magnetic core material; and a cover layer located on a surface of the particulate magnetic core material and including a crosslinked material, wherein the crosslinked material is formed by hydrolyzing a copolymer including a unit (A) having the below-mentioned formula (A) and a unit (B) having the below-mentioned formula (B) to prepare a material having a silanol group, and subjecting the material to a condensation reaction using an organic zirconium-containing catalyst;

(A)

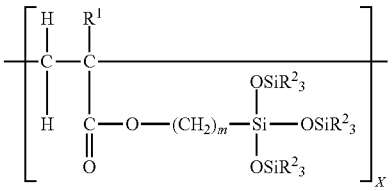

(B)

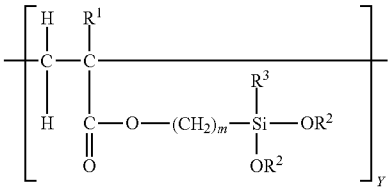

wherein each of $R^1$ represents a hydrogen atom or a methyl group, each of m is an integer of from 1 to 8, each of $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B, wherein X is from 10% by mole to 90% by mole and Y is from 90% by mole to 10% by mole.

2. The carrier according to claim 1, wherein the crosslinked material includes a unit obtained from the organic zirconium-containing catalyst.

3. The carrier according to claim 1, wherein the organic zirconium-containing catalyst is a zirconium chelate compound.

4. The carrier according to claim 3, wherein the zirconium chelate compound is zirconium tetraacetylacetonate.

5. The carrier according to claim 1, wherein when forming the crosslinked material, the organic zirconium-containing catalyst is used in an amount of from 0.5 to 20 parts by weight based on 100 parts by weight of the unit (B).

6. The carrier according to claim 1, wherein the copolymer has the following formula (1):

(1)

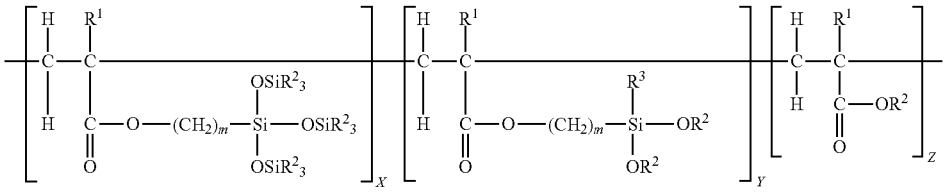

wherein each of R1 represents a hydrogen atom or a methyl group, each of m is an integer of from 1 to 8, each of R2 represents an alkyl group having 1 to 4 carbon atoms, and R3 represents an alkyl group having 1 to 8 carbon atoms or an alkoxyl group having 1 to 4 carbon atoms, wherein X is from 10% by mole to 40% by mole, Y is from 10% by mole to 40% by mole, and Z is from 30% by mole to 80% by mole, wherein Y+Z is greater than 60% by mole and less than 90% by mole.

7. The carrier according to claim 1, wherein the cover layer further includes a particulate electroconductive material.

8. The carrier according to claim 1, wherein the carrier has a volume resistivity of from $1\times10^{9}$ Ω·cm to $1\times10^{17}$ Ω·cm.

9. The carrier according to claim 1, wherein the cover layer has an average thickness of from 0.05 μm to 4 μm.

10. The carrier according to claim 1, wherein the particulate magnetic core material has a weight average particle diameter of from 20 μm to 65 μm.

11. The carrier according to claim 1, wherein the carrier has a magnetization of from 40 $Am^2$/kg to 90 $Am^2$/kg at a magnetic field of 1 kOe.

12. A two-component developer for developing an electrostatic latent image, comprising:

the carrier according to claim 1; and a toner.

13. The two-component developer according to claim 12, wherein the toner is a color toner.

14. The two-component developer according to claim 12, used as a supplementary developer, wherein a weight ratio (C/T) of the carrier (C) to the toner (T) is from 1/2 to 1/50.

15. A method for preparing a carrier, comprising:

applying a coating medium including a copolymer including a unit (A) having the below-mentioned formula (A) and a unit (B) having the below-mentioned formula (B), and an organic zirconium-containing catalyst to a particulate magnetic core material so that the copolymer is hydrolyzed to produce a material having a silanol group, and the material having a silanol group induces a condensation reaction with the organic zirconium-containing catalyst to form a cover layer including a crosslinked material on a surface of the particulate magnetic core material, (A)

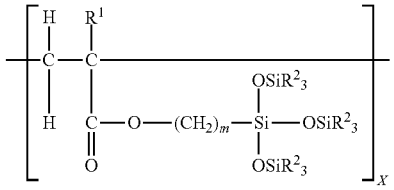

(B)

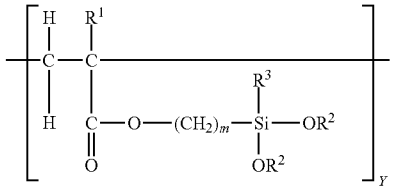

wherein each of $R^1$ represents a hydrogen atom or a methyl group, each of m is an integer of from 1 to 8, each of $R^2$ represents an alkyl group having 1 to 4 carbon atoms, $R^3$ represents an alkyl group having 1 to 8 carbon atoms or an alkoxyl group having 1 to 4 carbon atoms, and X and Y respectively represent molar ratios of the units A and B, wherein X is from 10% by mole to 90% by mole and Y is from 90% by mole to 10% by mole.

16. The method according to claim 15, further comprising:

heating the applied coating medium to a temperature of from 100° C. to 230° C. to accelerate the condensation reaction.

17. A developer container containing the two-component developer according to claim 12.

18. An image forming method comprising:

forming an electrostatic latent image on an image bearing member;

developing the electrostatic latent image with the two-component developer according to claim 12 to form a toner image on the image bearing member;

transferring the toner image to a recording material; and fixing the toner image to the recording material.

* * * * *